US006230090B1

(12) United States Patent
Takahashi et al.

(10) Patent No.: US 6,230,090 B1
(45) Date of Patent: May 8, 2001

(54) INTERFERENCE PREVENTION SYSTEM FOR TWO-PIECE BOOM TYPE HYDRAULIC EXCAVATOR

(75) Inventors: Ei Takahashi; Kazuhiro Sunamura, both of Tsuchiura; Yusuke Kajita, Ushiku, all of (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 0 days.

(21) Appl. No.: 09/142,234

(22) PCT Filed: Jan. 6, 1998

(86) PCT No.: PCT/JP98/00014

§ 371 Date: Sep. 3, 1998

§ 102(e) Date: Sep. 3, 1998

(87) PCT Pub. No.: WO98/30759

PCT Pub. Date: Jul. 16, 1998

(30) Foreign Application Priority Data

Jan. 7, 1997 (JP) ..... 9-000584

(51) Int. Cl.[7] ..... E02F 3/43

(52) U.S. Cl. ..... 701/50; 37/348; 91/419; 212/280

(58) Field of Search ..... 701/1, 50, 300; 37/414, 348; 91/361, 392, 418, 419, 448, 458, 459; 700/178; 212/276, 280

(56) References Cited

U.S. PATENT DOCUMENTS 5,136,928 * 8/1992 Hachisu ..... 91/392
5,490,081 * 2/1996 Kuromoto et al. ..... 91/392
5,704,141 * 1/1998 Miura et al. ..... 37/348
5,784,944 * 7/1998 Tozawa et al. ..... 91/361
5,957,989 * 9/1999 Egawa et al. ..... 701/50

FOREIGN PATENT DOCUMENTS 2-308018 12/1980 (JP) .
3-156037 7/1991 (JP) .
3-217523 9/1991 (JP) .
3-228929 10/1991 (JP) .
6-313323 11/1994 (JP) .
6-104985 12/1994 (JP) .
8-4046 1/1996 (JP) .
8-333767 12/1996 (JP) .

* cited by examiner

*Primary Examiner*—William A. Cuchlinski, Jr.
*Assistant Examiner*—Edward Pipala
(74) *Attorney, Agent, or Firm*—Mattingly, Stanger & Malur

(57) ABSTRACT

When an arm end exceeds a boundary line K2 and enters a slowdown area R1, a proportional solenoid pressure reducing valve 13 is operated to reduce a pilot pressure for slowing down a first boom cylinder 1A, thereby slowing down an arm end speed. When the arm end exceeds a boundary line K1 and enters a restoration area R2, a restoration gain is calculated in control gain block 200 depending on an intrusion amount by which the arm end enters the restoration area, while a feedback gain is calculated depending on an arm end speed at that time on the basis of functions 204, 205, 206, 207, 208 and 209. In accordance with these gains, a second boom 2 is automatically dumped depending on the intrusion amount of the arm end into the restoration area and the arm end speed at that time so that the arm end is moved for return to the slowdown area. As a result, such work as requiring a work front to be moved toward the operator is continuously smoothly performed and working efficiency is improved.

13 Claims, 18 Drawing Sheets

$$\Delta Z=\sqrt{(X_1-X)^2 + (Y_1-Y)^2}$$

$\Delta Z=\Delta Z$ WHEN ARM END IS IN SLOW-DOWN AREA $\Delta Z=-\Delta Z$ WHEN ARM END IS IN RESTORATION AREA

INTERFERENCE PREVENTION SYSTEM FOR TWO-PIECE BOOM TYPE HYDRAULIC EXCAVATOR

TECHNICAL FIELD

The present invention relates to an interference prevention system for a 2-piece boom type hydraulic excavator, and more particularly to an interference prevention system for a 2-piece boom type hydraulic excavator, which operates to restrict movement of a work front when a predetermined position of the work front comes close to an excavator body.

1. Background Art

A work front of a hydraulic excavator is made up of front members such as a boom and an arm, which are vertically movable, with a working appliance, e.g., a bucket, attached to a fore end of the arm. The boom of the work front is bent at a certain angle and is usually constituted by a single mono-boom. In some hydraulic excavators, a boom is divided into two parts, i.e., a first boom and a second boom. These hydraulic excavators are called 2-piece boom type hydraulic excavators.

In a 2-piece boom type hydraulic excavator, when manipulating the front members, such as the first boom, the second boom and the arm, through respective control levers, the operator can freely change an angle formed between the first boom and the second boom; hence there is a risk that the bucket may interfere with the excavator body, in particular an operating room (cab), depending on the angle formed between the first boom and the second boom. For that reason, an interference prevention system for preventing such interference is proposed in JP, A, 2-308018.

In the interference prevention system proposed in JP, A, 2-308018, potentiometers are provided at pivotally articulated portions of the first boom, the second boom and the arm to detect relative angles of the respective articulations, and an arm end position is calculated based on outputs from the potentiometers. When the calculated arm end position enters a preset danger area, a signal is output to actuate an alarm device. Also, when the calculated arm end position enters the preset danger area, an interference prevention controller outputs a signal to shift a switching valve, which is installed between an actuator for operating each front member and a control valve, to an off-position, thereby automatically stopping movement of the front member under operation.

2. Disclosure of the Invention

In the related art disclosed in JP, A, 2-308018, as described above, when the arm end enters the danger area, the movement of the front members is restricted so as to stop. Such control of stopping the front members is however disadvantageous in that when the operator performs work near the cab, it is difficult to continuously smoothly carry out the work that requires the work front to be moved in a direction toward the operator (cab), e.g., excavating and earth-releasing, thus resulting in a remarkable reduction in working efficiency.

An object of the present invention is to provide an interference prevention system for a 2-piece boom type hydraulic excavator with which such work as requiring a work front to be moved in a direction toward the operator is continuously smoothly performed and working efficiency is improved.

(1) To achieve the above object, the present invention provides an interference prevention system for a 2-piece boom type hydraulic excavator, the interference prevention system being installed in a 2-piece boom type hydraulic excavator comprising an excavator body, a work front mounted on the excavator body and having a plurality of front members including first and second booms and an arm which are vertically rotatable, a first boom cylinder for driving the first boom, a second boom cylinder for driving the second boom, an arm cylinder for driving the arm, a first-boom flow control valve for controlling a flow rate of a hydraulic fluid supplied to the first boom cylinder in accordance with an operation signal from first-boom operating means, a second-boom flow control valve for controlling a flow rate of a hydraulic fluid supplied to the second boom cylinder in accordance with an operation signal from second-boom operating means, and an arm flow control valve for controlling a flow rate of a hydraulic fluid supplied to the arm cylinder in accordance with an operation signal from arm operating means, the interference prevention system serving to restrict movement of the work front when a predetermined position of the work front comes close to the excavator body, wherein the interference prevention system comprises attitude detecting means for detecting an attitude of the work front, and control means for receiving detection signals from the attitude detecting means and, when the predetermined position of the work front comes close to the excavator body, outputting a command signal to the second-boom flow control valve so that the second boom is moved in a dumping direction.

With the present invention thus constructed, since the second boom is moved in the dumping direction when the predetermined position of the work front comes close to the excavator body, the work front is prevented from interfering with the excavator body or a cab without being stopped, and such work as requiring the work front to be moved toward the operator (cab) can be continuously, smoothly performed.

Also, since the above-mentioned control is made by moving the second boom in the dumping direction, which is less frequently employed in actual work, rather than the arm, the interference avoidance control can be achieved allowing the operator to feel less awkward during the operation.

(2) In the above (1), preferably, when the first boom is operated in a rising direction by the operating means for the first boom, the control means makes control to move the second boom in the dumping direction while continuing to raise the first boom.

With this feature, when the predetermined position of the work front comes close to the excavator body, the predetermined position of the work front is controlled to move while going around the excavator body (cab) with a combination of the first-boom raising operation and the second-boom dumping operation. As a result, such work as requiring the work front to be moved toward the operator (cab) can be continuously smoothly performed while avoiding interference between the work front and the excavator body.

(3) In the above (2), preferably, the control means receives an operation signal in the first-boom raising direction output from the operating means for the first boom, and modifies the operation signal in the first-boom raising direction such that first-boom raising operation is slowed down as the predetermined position of the work front comes closer to the excavator body, and thereafter the first-boom raising operation is continued at a slowed-down speed.

With this feature, since the first-boom raising operation is slowed down when the predetermined position of the work front comes close to the excavator body, the second boom cylinder can be supplied with the hydraulic fluid at a sufficient flow rate even when there is a limit in maximum capacity of a hydraulic pump. Accordingly, the second boom can be quickly dumped and the work front is surely prevented from interfering with the excavator body.

Also, since the first-boom raising operation is slowed down, a distance left between the predetermined position of the work front and the excavator body when the former comes close to the latter is suppressed, and therefore interference between the work front and the excavator body is surely prevented with the dumping of the second boom.

(4) In the above (2), preferably, the control means receives an operation signal in a second-boom crowding direction output from the operating means for the second boom and an operation signal in an arm crowding direction output from the operating means for the arm, and modifies the operation signal in the second-boom crowding direction and the operation signal in the arm crowding direction such that when the first boom is not moved in the rising direction, the work front is slowed down as the predetermined position of the work front comes closer to the excavator body and thereafter the work front is stopped.

With this feature, in work carried out by not operating the first boom in the rising direction, but operating the second boom and/or the arm in the crowding direction, the work front is controlled to just slow down and stop when the predetermined position of the work front comes close to the excavator body. Hence the work front is avoided from moving in a direction away from the excavator body due to the dumping of the second boom.

Here, in work carried out by operating the second boom and/or the arm in the crowding direction without raising the first boom, the operator intends to carry out the operation only requiring the work front to be moved toward the operator (cab) in many cases. In such work, if the work front is moved in a direction away from the excavator body by dumping the second boom, the movement of the work front would be unexpected one for the operator, and if there is an object such as a wall in the dumping direction, the work front may hit against the object. By slowing down and stopping the work front as mentioned above, the movement unexpected for the operator is avoided and good operability is ensured.

(5) In the above (2), preferably, the control means receives an operation signal in an arm crowding direction output from the operating means for the arm, and modifies the operation signal in the arm crowding direction such that when the first boom is moved in the rising direction, an arm crowding operation is slowed down as the predetermined position of the work front comes closer to the excavator body, and thereafter the arm crowding operation is continued at a slowed-down speed.

With this feature, when the predetermined position of the work front comes close to the excavator body under the first-boom raising operation and the arm crowding operation, the arm crowding operation is allowed to continue at a certain speed after being slowed down. As a result, the arm crowding operation is avoided from repeating the stop and slowdown in the restoration control with the dumping of the second boom, and smooth interference avoidance control can be achieved.

(6) In the above (1) or (2), preferably, the control means calculates a target speed of the second boom in the dumping direction corresponding to a moving speed of the predetermined position of the work front, and makes the control so that the second boom is moved at the calculated target speed.

With this feature, when the second boom is controlled so as to dump, a dumping speed of the second boom in match with the moving speed of the predetermined position of the work front is obtained and smooth interference avoidance control is achieved.

(7) In the above (6), preferably, the control means calculates the target speed of the second boom in the dumping direction to provide a higher target speed value as a moving speed of the predetermined position of the work front increases.

(8) In the above (1) or (2), preferably, the control means calculates a target speed of the second boom in the dumping direction that increases as the predetermined position of the work front comes closer to the excavator body, and makes the control so that the second boom is moved at the calculated target speed.

With these features, the dumping speed of the second boom is increased as the predetermined position of the work front comes closer to the excavator body, and interference between the work front and the excavator body can be surely prevented.

(9) In the above (1) or (2), preferably, the attitude detecting means includes means for calculating a distance from the predetermined position of the work front to an area previously set around the excavator body, and the control means modifies the operation signals from the operating means such that when the calculated distance is not larger than a preset first control start distance, the work front is gradually slowed down as the calculated distance becomes smaller, modifies the operation signals from the operating means such that when the calculated distance reaches a preset second control start distance smaller than the first control start distance, the front members are stopped except at least operation of raising the first boom, and makes control such that when the calculated distance is not larger than the second control start distance, the second boom is moved in the dumping direction.

With this feature, when the predetermined position of the work front comes close to the excavator body, the work front is first controlled at the calculated distance being not larger than the first control start distance such that the front members are slowed down and then stopped except at least operation of raising the first boom. After that, at the calculated distance being not larger than the second control start distance, the second boom is controlled to move in the dumping direction. The second boom cylinder can be therefore supplied with the hydraulic fluid at a sufficient flow rate even when there is a limit in maximum capacity of a hydraulic pump. Accordingly, the second boom can be quickly dumped and the work front is surely prevented from interfering with the excavator body.

Also, since the front members are slowed down before starting to control the second boom to dump, an intrusion amount by which the predetermined position of the work front enters beyond the second control start distance is suppressed, and interference between the work front and the excavator body can be surely prevented.

(10) In the above (9), preferably, the control means modifies the operation signals from the operating means such that when the calculated distance reaches the preset second control start distance smaller than the first control start distance, the front members are stopped except operations of raising the first boom and crowding the arm.

With this feature, when the predetermined position of the work front comes close to the excavator body under the first-boom raising operation and the arm crowding operation to such an extent that the calculated distance is not larger than the second control start distance, the arm crowding operation is allowed to continue at a certain speed. As a result, the arm crowding operation is avoided from repeating the stop and slowdown in the restoration control with the dumping of the second boom, and smooth interference avoidance control can be achieved.

(11) In the above (9), preferably, the control means receives the operation signals from the operating means and modifies the operation signals from the operating means such that a degree of slowdown is reduced with an increase in stroke amounts by which the operating means are operated.

With this feature, the slowdown control can be always started upon reaching near the first control start distance regardless of the stroke amounts of the operating means, and smooth interference avoidance control can be achieved.

(12) In the above (1) or (2), preferably, when the predetermined position of the work front comes close to the excavator body, the control means outputs command signals to the second-boom flow control valve and the arm flow control valve so that the second boom and the arm are both moved in the dumping direction.

With this feature, quick interference avoidance control can be achieved with good response.

(13) In the above (1) or (2), preferably, when the predetermined position of the work front comes close to the excavator body, the control means may output a command signal to the arm flow control valve so that the arm is moved in the dumping direction instead of the second boom.

BEST MODE FOR CARRYING OUT THE INVENTION

Several embodiments of the present invention will be described hereunder with reference to the drawings.

To begin with, a first embodiment of the present invention will be described with reference to FIGS. 1–11.

Figure 1:
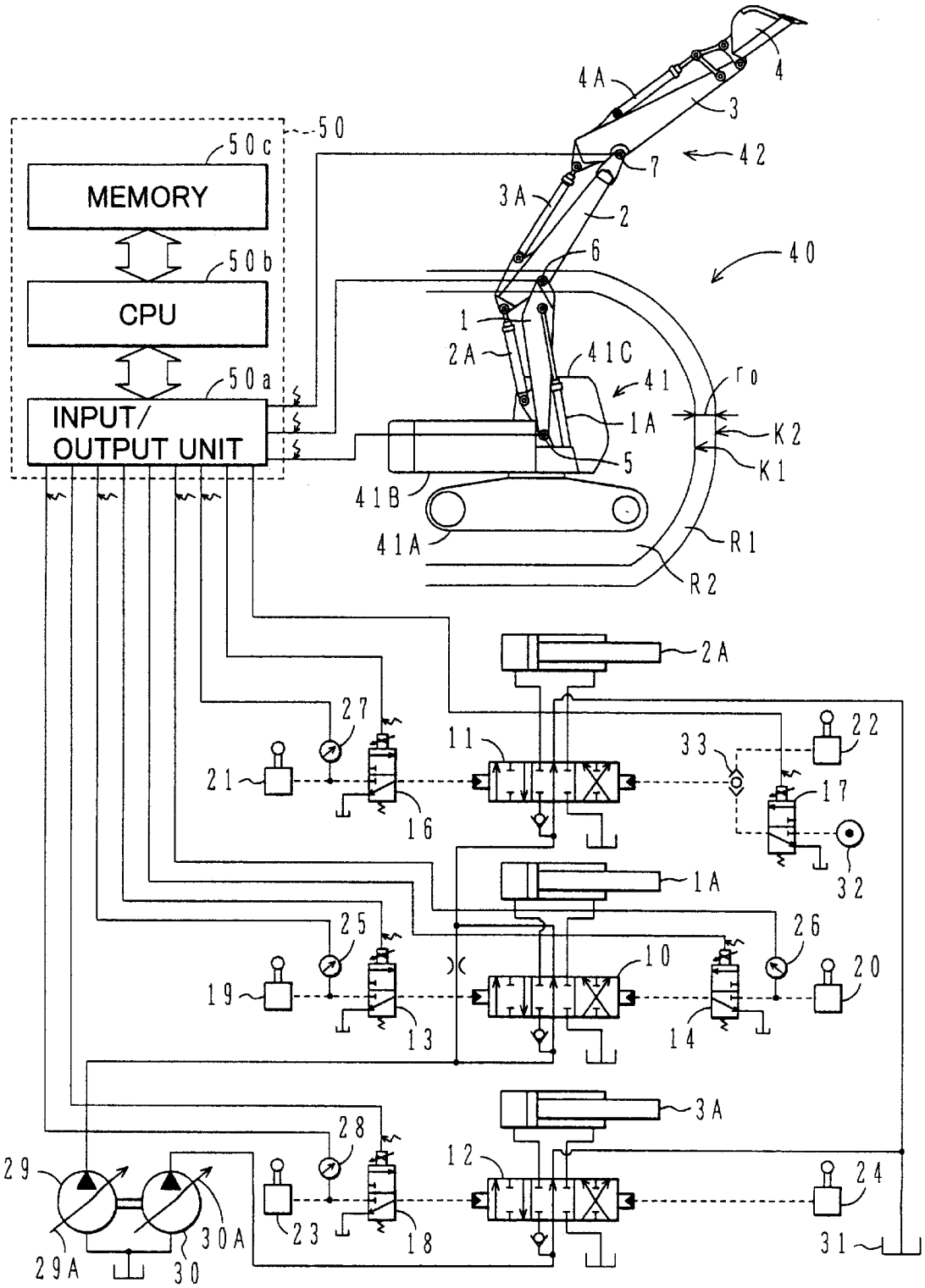
FIG. 1 is a schematic view showing an interference prevention system for a 2-piece boom type hydraulic excavator according to a first embodiment of the present invention.

In FIG. 1, a 2-piece boom type hydraulic excavator 40, to which the present invention is applied, has an excavator body 41 and a multi-articulated work front 42. The excavator body 41 comprises a lower track structure 41A, an upper revolving structure 41B rotatably mounted on the lower track structure 41A, and a cab 41C provided on the upper revolving structure 41B. The work front 42 comprises a first boom 1 vertically rotatable attached to a front portion of the upper revolving structure 41B, a second boom 2 vertically rotatably attached to the first boom 1, an arm 3 vertically rotatably attached to the second boom 2, and a working appliance, e.g., a bucket 4, vertically rotatably attached to the arm 3.

The first boom 1, the second boom 2, the arm 3 and the bucket 4 are driven respectively by a first boom cylinder 1A, a second boom cylinder 2A, an arm cylinder 3A and a bucket cylinder 4A.

A hydraulic drive circuit of the hydraulic excavator 40 is shown in a lower half of FIG. 1. The hydraulic drive circuit includes the first boom cylinder 1A, the second boom cylinder 2A and the arm cylinder 3A mentioned above; hydraulic pumps 29 and 30 provided with respective displacement varying mechanisms 29A and 30A; a first boom flow control valve 10 and a second boom flow control valve 11 for controlling respective flow rates of a hydraulic fluid supplied from the hydraulic pump 29 to the first boom cylinder 1A and the second boom cylinder 2A; an arm flow control valve 12 for controlling a flow rate of a hydraulic fluid supplied from the hydraulic pump 30 to the arm cylinder 3A; pilot valves 19, 20 for outputting pilot pressures as operation signals to the first boom flow control valve 10; pilot valves 21, 22 for outputting pilot pressures as operation signals to the second boom flow control valve 11; and pilot valves 23, 24 for outputting pilot pressures as operation signals to the arm flow control valve 12. The pilot valves 19, 20 are selectively operated depending on the direction in which a common control lever is operated, and output, as command signals, pilot pressures depending on an input amount by which the control lever is operated. Also, each pair of pilot valves 21, 22 and pilot valves 23, 24 are selectively operated depending on the direction in which a common control lever is operated, and output, as command signals, pilot pressures depending on a stroke amount by which the control lever is operated. The flow control valves 10, 11, 12 are each controlled by the pilot pressure output from the pilot valve so as to have an opening area that corresponds to the stroke amount of the control lever (pilot pressure). The flow rate and supply direction of the hydraulic fluid are thus controlled.

In FIG. 1, the hydraulic drive circuit shows only sections related to the first boom cylinder 1A, the second boom cylinder 2A and the arm cylinder 3A, while other sections related to the bucket cylinder 4A and actuators for swing and traveling are omitted.

An interference prevention system of the present invention is installed in the 2-piece boom type hydraulic excavator described above. The interference prevention system comprises a first boom angle sensor 5 provided in a joint portion between the upper revolving structure 41B and the first boom 1 for detecting a relative angle formed between the upper revolving structure 41B and the first boom 1, a second boom angle sensor 6 provided in a joint portion between the first boom 1 and the second boom 2 for detecting a relative angle formed between the first boom 1 and the second boom 2, an arm angle sensor 7 provided in a joint portion between the second boom 2 and the arm 3 for detecting a relative angle formed between the second boom 2 and the arm 3, pressure sensors 25, 26 for detecting the respective pilot pressures output from the pilot valves 19, 20, a pressure sensor 27 for detecting the pilot pressure output from the pilot valve 21, a pressure sensor 28 for detecting the pilot pressure output from the pilot valve 23, proportional solenoid pressure reducing valves 13, 14 for reducing the respective pilot pressures output from the pilot valves 19, 20, a proportional solenoid pressure reducing valve 16 for reducing the pilot pressure output from the pilot valve 21, a proportional solenoid pressure reducing valve 17 for reducing a pilot pressure supplied from a pilot hydraulic source 32, a proportional solenoid pressure reducing valve 18 for reducing the pilot pressure output from the pilot valve 23, a shuttle valve 33 for selecting higher one of the pilot pressure output from the pilot valve 22 and the pilot pressure output from the proportional solenoid pressure reducing valve 17 and applying the selected pilot pressure to the flow control valve 11, and a controller 50 made up of an input/output unit 50*a*, a CPU 50*b* and a memory 50*c*.

The controller 50 receives signals from the angle sensors 5, 6, 7 and the pressure sensors 25, 26, 27, 28, and outputs control signals for controlling the work front 42 to the proportional solenoid pressure reducing valves 13, 14, 16, 17, 18 based on the received angle signals and pressure signals.

Denoted by 31 is a reservoir.

An interference prevention control process of this embodiment will be described below.

In this embodiment, as shown in FIG. 1, a slowdown area R1 and a restoration area R2 are set. Slowdown control is performed in the slowdown area R1 and restoration control is performed in the restoration area R2.

Here, K1 indicates a boundary line representing the boundary between the slowdown area R1 and the restoration area R2, and K2 indicates a boundary line representing the boundary between the slowdown area R1 and an area where control is not performed, i.e., slowdown start line. The boundary line K2 is set a predetermined distance rO spaced from the boundary line K1.

Figure 2:
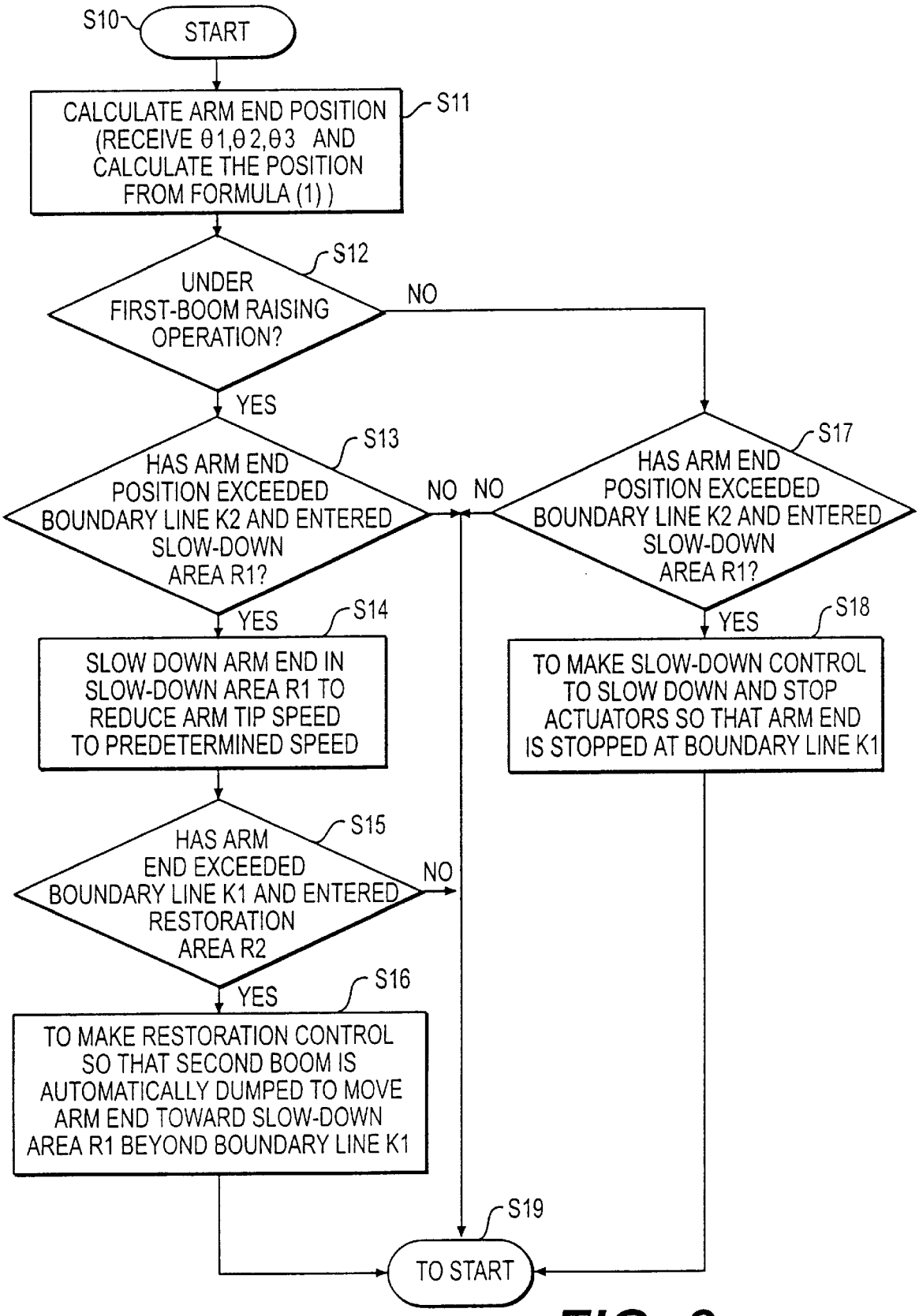
FIG. 2 is a flowchart for explaining an interference prevention control process according to the first embodiment of the present invention.

FIG. 2 is a flowchart showing an outline of the interference prevention control process.

Figure 3:
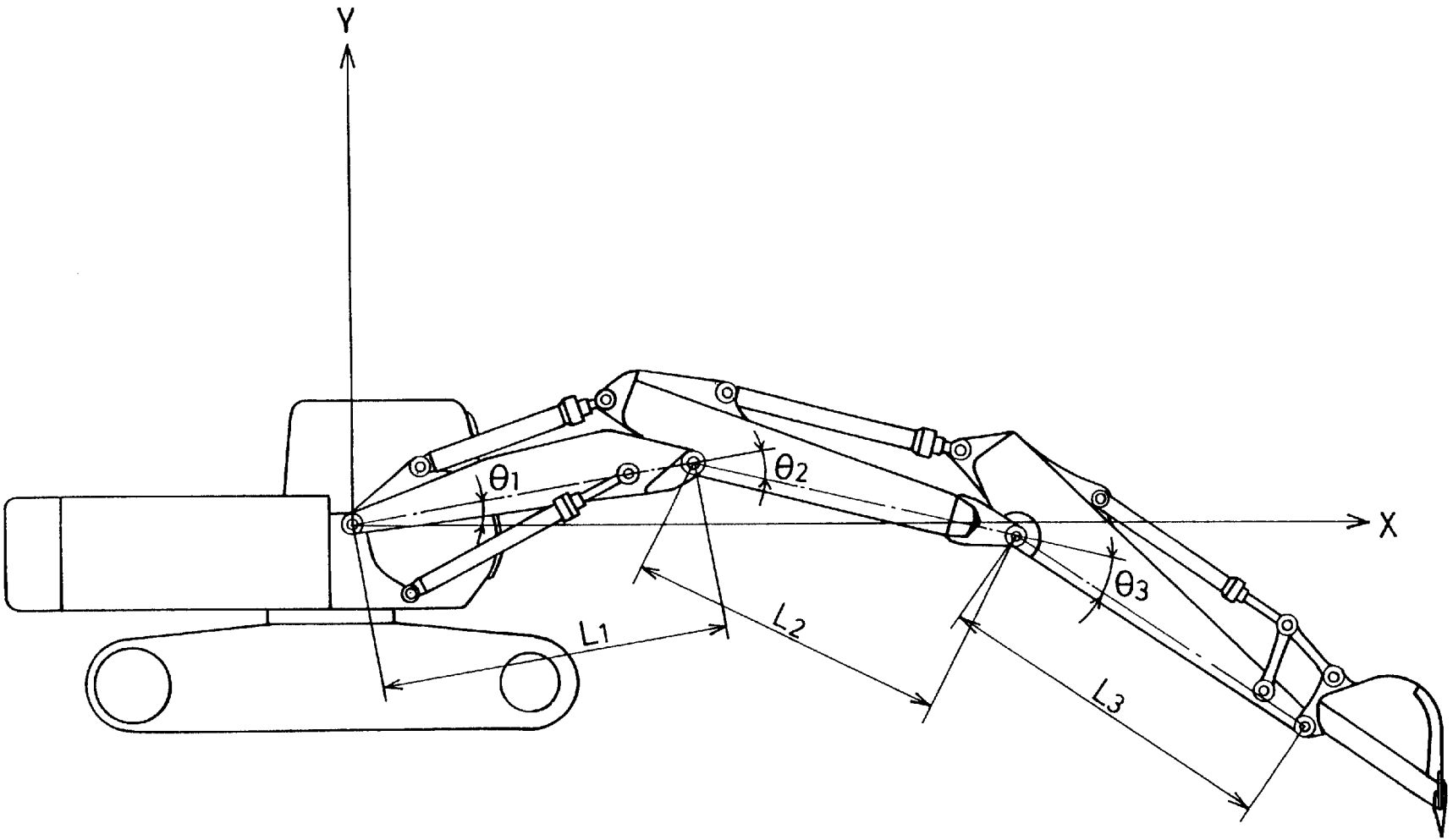
FIG. 3 is a view showing dimensions, angles and a coordinate system of a work front.

First, an arm end position is calculated based on the signals from the angle sensors 5, 6, 7 (step 11). The arm end position is calculated as values on an XY-coordinate system with a base end of the first boom 1 defined as the origin, as shown in FIG. 3. A calculation formula is given by the following formula (1):

$$X = L1 \cos \theta 1 + L2 \cos(\theta 1 + \theta 2) + L3 \cos(\theta 1 + \theta 2 + \theta 3)$$

$$Y = L1 \sin \theta 1 + L2 \sin(\theta 1 + \theta 2) + L3 \sin(\theta 1 + \theta 2 + \theta 3) \quad (1)$$

L1: length of the first boom 1

L2: length of the second boom 2

L3: length of the arm 3

θ1: angle detected by the first boom angle sensor 5

θ2: angle detected by the second boom angle sensor 6

θ3: angle detected by the arm angle sensor 7

Then, it is determined whether or not the first boom is under raising operation (step 12). If YES, it is determined whether or not the arm end position has exceeded the boundary line K2 and entered the slowdown area R1 (step 13). If NO, it is also determined whether or not the arm end position has exceeded the boundary line K2 and entered the slowdown area R1 (step 17). If the arm end position has not yet exceeded the boundary line K2 and entered the slowdown area R1, the process flow returns to the start without carrying out any control (step 19).

If the arm end position has exceeded the boundary line K2 and entered the slowdown area R1 on condition that the first boom is under raising operation, slowdown control is performed such that the proportional solenoid pressure reducing valves 13, 14, 16, 18 are operated to reduce the respective pilot pressures to slow down and then stop the actuators for slowing down the cylinders 1A, 2A, 3A of the first boom 1, the second boom 2 and the arm 3, thus causing the arm end to stop at the boundary line K1 (steps 12, 17 and 18). Details of the slowdown control will be described later.

If the arm end position has exceeded the boundary line K2 and entered the slowdown area R1 on condition that the first boom is not under raising operation, slowdown control is performed such that the proportional solenoid pressure reducing valves 13, 14, 16, 18 are operated to reduce the respective pilot pressures for slowing down the cylinders 1A, 2A, 3A of the first boom 1, the second boom 2 and the arm 3, whereby the arm end position is slowed down in the slowdown area R1 and the arm end speed is reduced to a predetermined speed (steps 12, 13 and 14).

Next, it is determined whether or not the arm end position has exceeded the boundary line K1 and entered the restoration area R2 (step 15). If the arm end has not exceeded the boundary line K1 and entered the restoration area R2, the process flow returns to the start (step 19).

If the arm end has exceeded the boundary line K1 and entered the restoration area R2, restoration control is performed such that the proportional solenoid pressure reducing valve 17 is operated to reduce the pilot pressure to make control for automatically dumping the second boom 2, thus causing the arm end position to move back into the slowdown area R1 outside the boundary line K1. As a result of this operation, the predetermined position of the work front 42, e.g., the bucket 4, is avoided from interfering with the cab 41C. Details of the restoration control will be described later.

The above processing is executed in the controller 50. A control algorithm of the controller 50 will be described below with reference to FIGS. 4–11.

First, the overall control algorithm of the controller 50 will be described with reference to FIG. 4.

Figure 4:
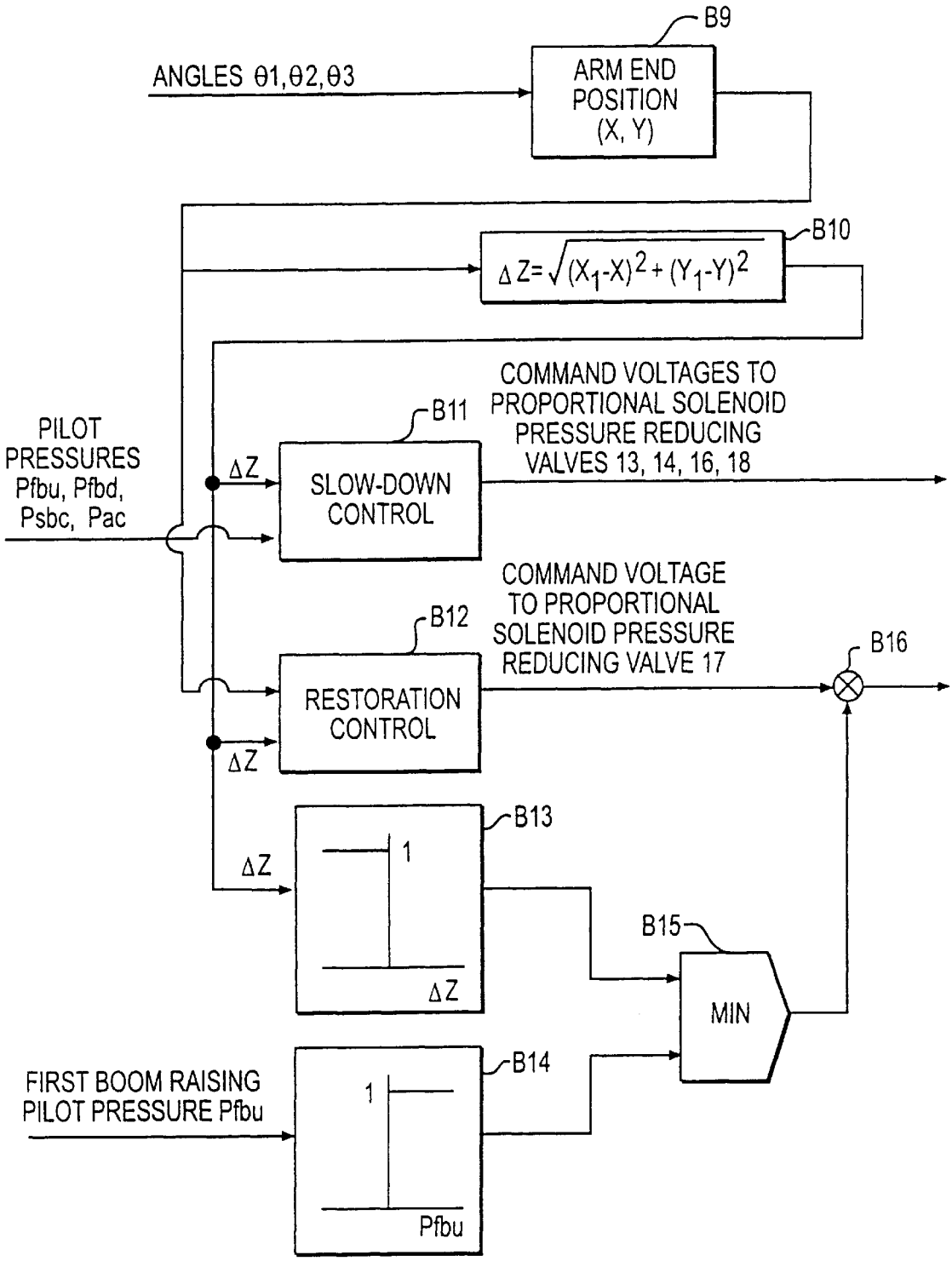
FIG. 4 is a functional block diagram showing a control algorithm of a controller.
Figure 5:
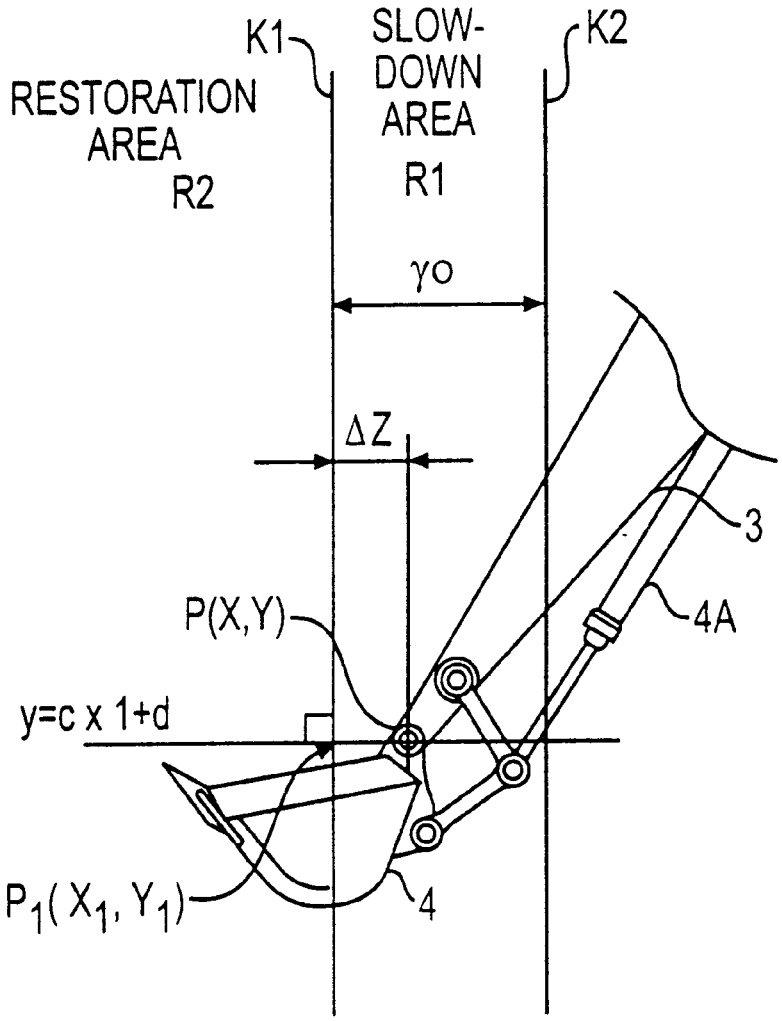
FIG. 5 is a view for explaining a manner of calculating a distance deviation ΔZ from the position of an arm end to the boundary line of a restoration area.

In FIG. 4, the controller receives the signals from the angle sensors 5, 6, 7 and calculates the arm end position based on the detected angles θ1, θ2, θ3 in a block B9. Then, it calculates a deviation ΔZ given by the shortest distance from the arm end position, i.e., (X, Y), to the boundary line K1 in a block B10. Details of this calculation is shown in FIG. 5. The deviation ΔZ is calculated as a positive value when the arm end is in the slowdown area R1 or in the area where the control is not performed, and as a negative value when it is in the restoration area R2.

Next, the deviation ΔZ calculated in the block B10 is input to blocks B11, B12 and B13.

In the block B11, the signals from the pressure sensors 25, 26, 27, 28 are further received, and command voltages for the proportional solenoid valves 13, 14, 16, 18 are calculated from pilot pressures $P_{fbu}$, $P_{fbd}$, $P_{sbc}$, $P_{ac}$ and the deviation ΔZ in accordance with the control algorithm for the slowdown control.

In the block B12, a command voltage for the proportional solenoid valve 17 is calculated from the arm end position (X, Y), calculated in the block B9, and the deviation ΔZ in accordance with the control algorithm for the restoration control.

In the block B13, the controller outputs a 0-level signal when the deviation ΔZ is positive, and a 1-level signal when it is negative. Further, in a block B14, the controller receives the signal from the pressure sensor 25, and outputs a 1-level signal when the first-boom raising pilot pressure $P_{fbu}$ is input, and a 0-level signal when it is not input.

In a block B15, minimum one of both output signals from the blocks B13, B14 is selected (MIN-selection), and the selected signal is multiplied in a block B16 by the command voltage for the proportional solenoid valve 17 output from the block B12 for the restoration control so that the restoration control of the block B12 is performed only when the output signals from the blocks B13, B14 are both 1-level signals.

Figure 6:
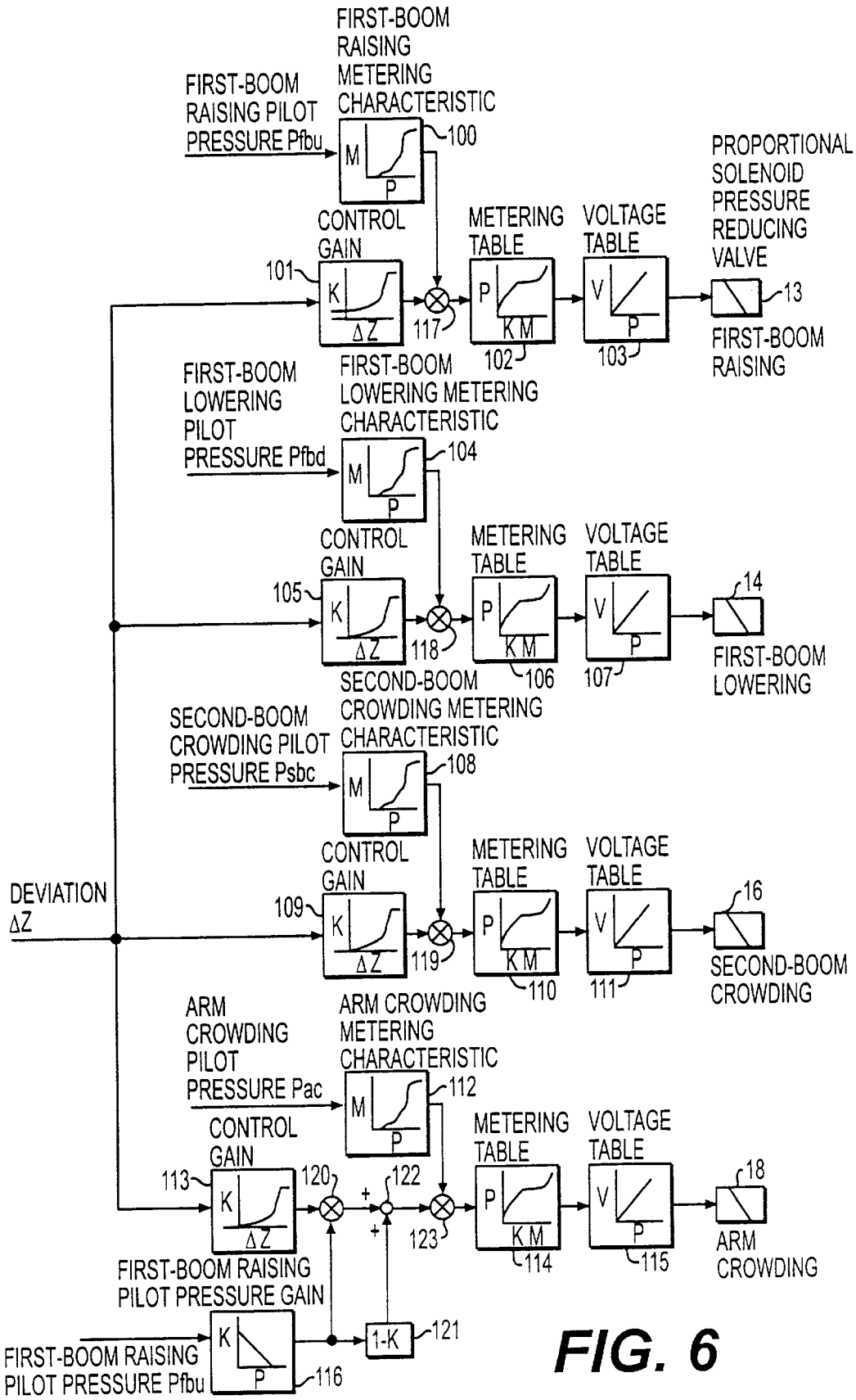
FIG. 6 is a functional block diagram showing details of slowdown control.

Details of the slowdown control of the block B11 is shown in a functional block diagram of FIG. 6.

First, control of the proportional solenoid pressure reducing valve 13 for raising the first boom will be described. A control gain block 101 calculates a slowdown gain $K_{fbu}$ from the deviation ΔZ. A first-boom raising metering characteristic block 100 calculates a cylinder target speed $M_{fbu}$ from the first-boom raising pilot pressure $P_{fbu}$. A block 117 multiplies the slowdown gain $K_{fbu}$ by the cylinder target speed $M_{fbu}$. A target pilot pressure $P_{fbun}$ is calculated from a resulting value by referring to a metering table 102, and the calculated pilot pressure is converted, by referring to a voltage table 103, into an output voltage for the proportional solenoid pressure reducing valve 13 for raising the first boom, followed by being output to the valve 13.

Figure 7A:
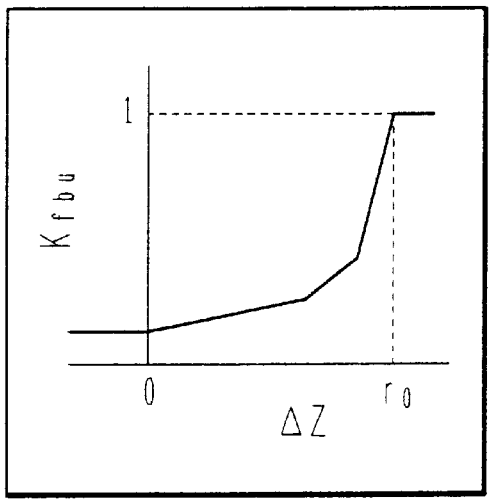
FIGS. 7*a*, 7*b* and 7*c* show a set of graphs each showing the relationship between the deviation ΔZ and a slowdown gain set in a control gain block in enlarged scale.
Figure 7B:
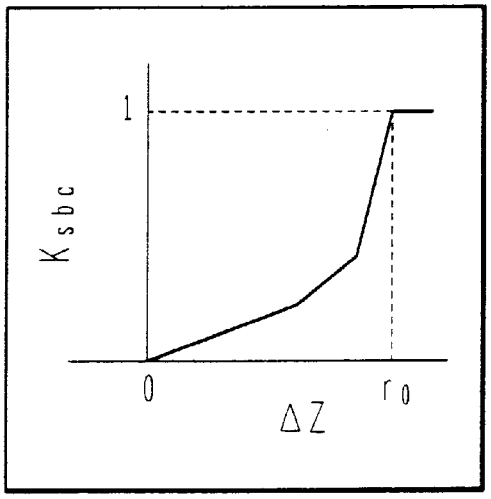
Figure 7C:
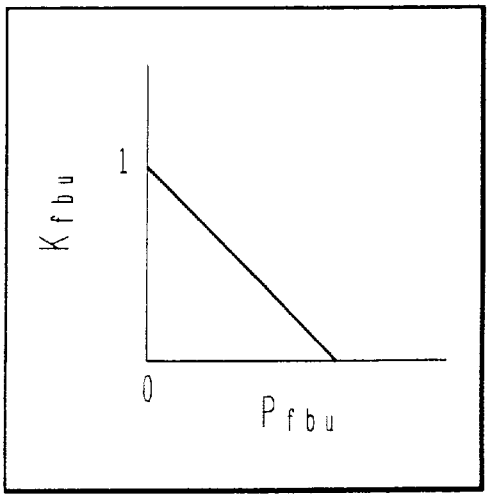

The relationship between the deviation ΔZ and the slowdown gain $K_{fbu}$ set in the control gain block 101 is shown in FIG. 7(*a*) in enlarged scale. The relationship between the deviation ΔZ and the slowdown gain $K_{fbu}$ is set as follows. When the deviation ΔZ is larger than the slowdown start distance r0, the slowdown gain $K_{fbu}$ is 1. When the deviation ΔZ is not larger than the slowdown start distance r0, the slowdown gain $K_{fbu}$ is gradually reduced as the deviation ΔZ reduces. When the deviation ΔZ becomes 0, the slowdown gain $K_{fbu}$ has a certain value larger than 0. When the deviation ΔZ is given by a negative value, the slowdown gain $K_{fbu}$ is kept at the value taken when the deviation ΔZ is 0. With the above setting relationship, the slowdown gain $K_{fbu}$ in the restoration area R2 is given by a value larger than 0, enabling the first boom 1 to be moved in the restoration area R2.

Figure 8A:
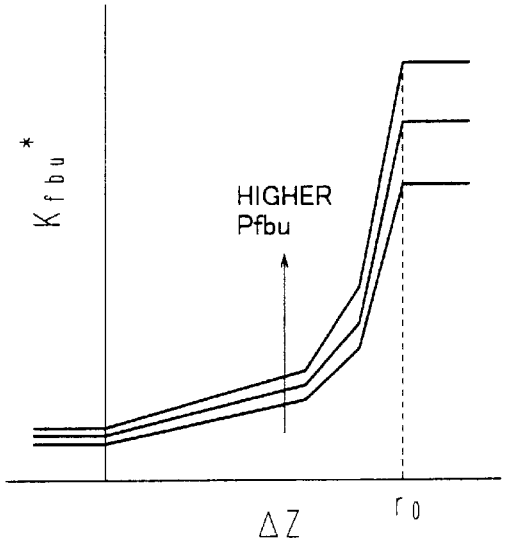
FIGS. 8*a*, 8*b* and 8*c* show a set of graphs each showing how the setting relationship between the deviation ΔZ and the slowdown gain changes depending on a pilot pressure.
Figure 8B:
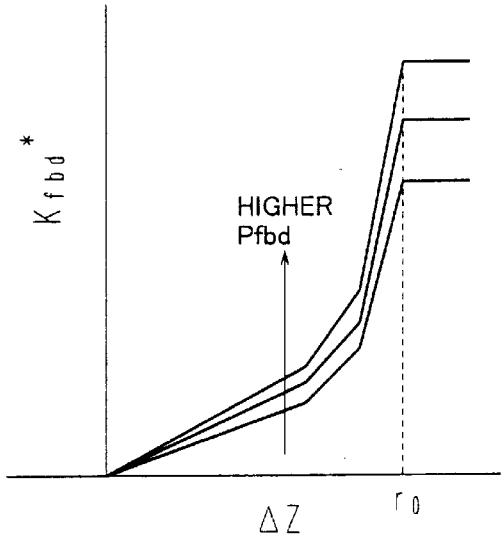
Figure 8C:
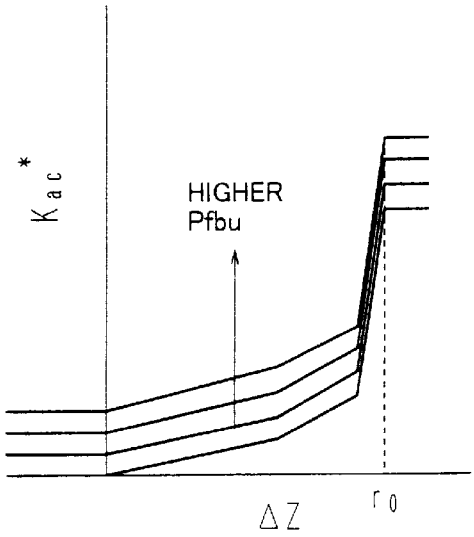

The relationship between the first-boom raising pilot pressure $P_{fbu}$ and the cylinder target speed $M_{fbu}$ set in the first-boom raising metering characteristic block 100 is determined depending on an opening area characteristic of the flow control valve 10 in the direction to raise the first boom. The slowdown gain $K_{fbu}$ multiplied by the cylinder target speed $M_{fbu}$ in the block 117 is modified, as shown in FIG. 8(*a*), into a slowdown gain $K_{fbu*}$ which increases as the first-boom raising pilot pressure $P_{fbu}$ becomes higher. As a result, the slowdown control can be performed depending on an operating speed at which the first boom is raised.

In other words, when the deviation ΔZ becomes not larger than the slowdown start distance r0, the slowdown control is started in accordance with the characteristic of FIG. 7(*a*) regardless of the level of the first-boom raising pilot pressure $P_{fbu}$, and smooth slowdown control is always ensured.

A characteristic of the metering table 102 is a reversal of the first-boom raising metering characteristic of the block 100.

The proportional solenoid pressure reducing valve 14 for lowering the first boom and the proportional solenoid pressure reducing valve 16 for crowding the second boom are also controlled, similarly to the proportional solenoid pressure reducing valve 13 for raising the first boom, with a set of a control gain block 105, a first-boom lowering metering characteristic block 104, a multiplying block 118, a metering table 106 and a voltage table 107, and a set of a control gain block 109, a second-boom crowding metering characteristic block 108, a multiplying block 119, a metering table 110 and a voltage table 111, respectively.

In the control gain blocks 105, 109, however, the relationship between the deviation ΔZ and the slowdown gain is set such that the slowdown gains $K_{fbd}$, $K_{sbc}$ are both reduced to zero when the deviation ΔZ becomes not larger than 0, as shown in FIG. 7(*b*) in enlarged scale. The operations of lowering the first boom and crowding the second boom are thereby stopped at the boundary line K1.

Further, the slowdown gain $K_{fbd}$ multiplied by the cylinder target speed $M_{fbd}$ in the block 118, for example, is modified, as shown in FIG. 8(*b*), into a slowdown gain $K_{fbd*}$ which increases as the first-boom lowering pilot pressure $P_{fbd}$ becomes higher. Accordingly, as with the case of FIG. 8(*a*), the slowdown control can be performed depending on an operating speed at which the first boom is lowered.

Next, control of the proportional solenoid pressure reducing valve 18 for crowding the arm will be described. A control gain block 113 calculates a slowdown gain $K_{ac}$ from the deviation ΔZ. A first-boom raising pilot pressure gain block 116 calculates a gain $K_{fbu}$ from the first-boom raising pilot pressure $P_{fbu}$. Also, an arm crowding metering characteristic block 112 calculates a cylinder target speed $M_{ac}$ from the arm crowding pilot pressure $P_{ac}$.

The relationship set in the control gain block 113 is substantially the same as set in the control gain block 105.

The relationship between the first-boom raising pilot pressure $P_{fbu}$ and the gain $K_{fbu}$ set in the first-boom raising pilot pressure control gain block 116 is shown in FIG. 7(*c*) in enlarged scale. The relationship between the first-boom raising pilot pressure $P_{fbu}$ and the gain $K_{fbu}$ is set as follows. When the pilot pressure $P_{fbu}$ is at maximum, the gain $K_{fbu}$ is 0. As the pilot pressure $P_{fbu}$ lowers, the gain $K_{fbu}$ is gradually increased. Then, when the pilot pressure $P_{fbu}$ lowers down to near 0, the gain $K_{fbu}$ becomes 1.

The three gains obtained in the blocks 112, 113, 116 are processed by being multiplied in blocks 120–123 to determine a modified slowdown gain $K_{ac*}$ in accordance with the following formula:

$$K_{ac^*}=(1-K_{fbu}+K_{ac}\times K_{fbu})\times M_{ac} \quad (2)$$

With such processing, as shown in FIG. 8(*c*), the modified slowdown gain $K_{ac^*}$ is set to increase as the first-boom raising pilot pressure $P_{fbu}$ becomes higher, thereby suppressing a slowdown amount so that the arm end enters the restoration area R2 while maintaining a certain arm crowding speed corresponding to the first-boom raising speed at the time when the arm end exceeds the boundary line K1. Also, similarly to the operation of raising the first boom, for example, the modified slowdown gain $K_{ac^*}$ is increased as the arm crowding pilot pressure $P_{ac}$ becomes higher, thus enabling the slowdown control to be performed depending on an operating speed of the arm 3.

Then, a target pilot pressure $P_{acn}$ is calculated from the modified slowdown gain $K_{ac^*}$ by referring to a metering table 114, and the calculated pilot pressure is converted, by referring to a voltage table 115, into an output voltage for the proportional solenoid pressure reducing valve 18 for crowding the arm, followed by being output to the valve 18.

Figure 9:
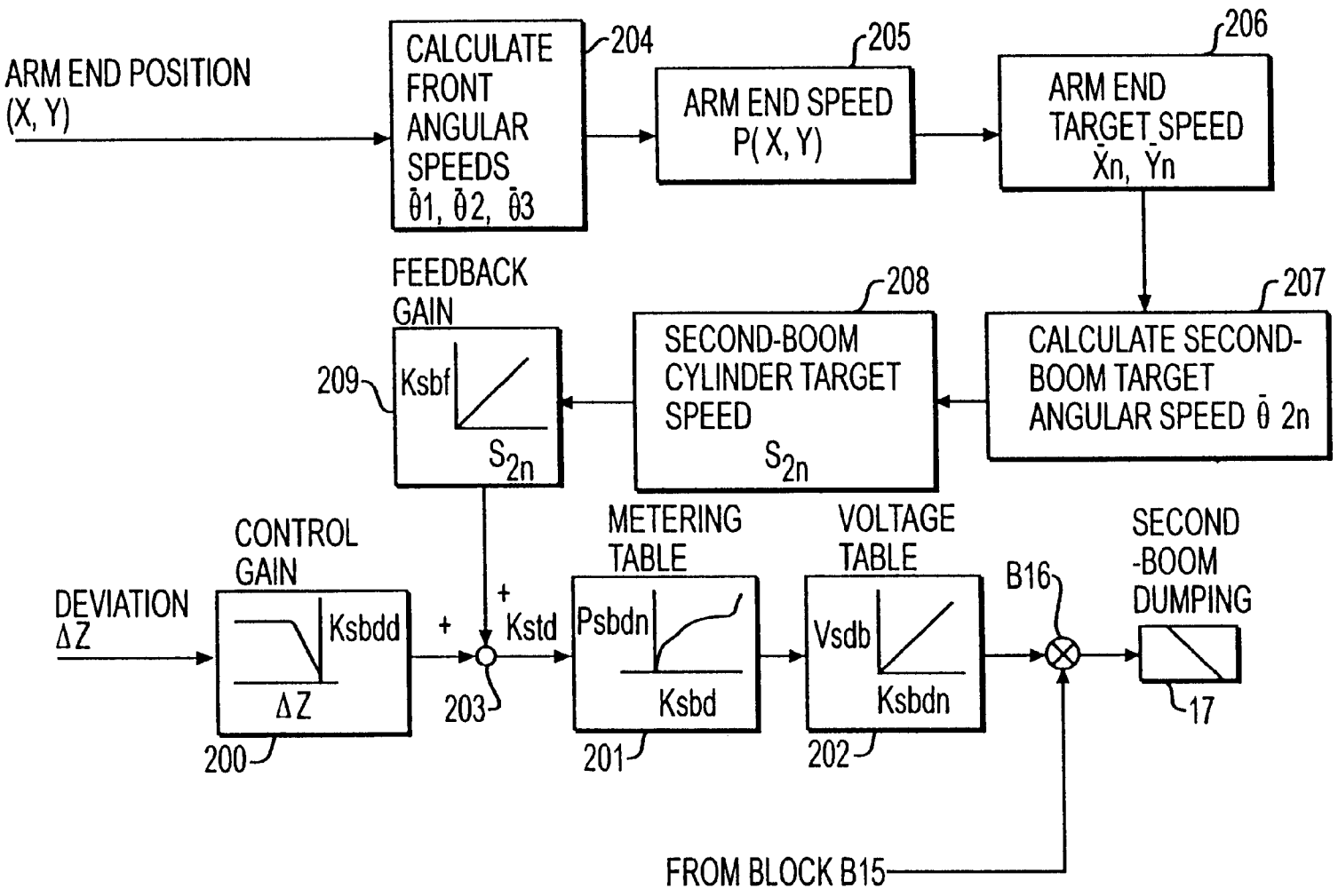
FIG. 9 is a functional block diagram showing details of restoration control.

Details of the restoration control of the block B12 is shown in a functional block diagram of FIG. 9.

A control gain block 200 calculates a restoration gain $K_{sbdd}$ from the deviation ΔZ. Also, a block 204 calculates respective front angular speeds ($\theta'_1$, $\theta'_2$, $\theta'_3$) (where' represents differentiation) of the first boom 1, the second boom 2 and the arm 3 from the coordinate values (X, Y) of the arm end position calculated in the block B9 of FIG. 4. Then, a block 205 determines an arm end speed (X', Y') from the front angular speeds ($\theta'_1$, $\theta'_2$, $\theta'_3$), and a block 206 calculates an arm end target speed ($X'_n$, $Y'_n$) from the arm end speed (X', Y'). Subsequently, a block 207 calculates a second-boom target angular speed $\theta'_{2n}$ from the arm end target speed ($X'_n$, $Y'_n$), and a block 208 determines a second-boom cylinder target speed $S_{2n}$ from the second-boom target angular speed $\theta'_{2n}$. Further, a feedback gain block 209 determines a feedback gain $K_{sbf}$ from the second-boom cylinder target speed $S_{2n}$.

The restoration gain $K_{sbdd}$ and the feedback gain $K_{sbf}$ thus obtained are added to each other in an adder 203. A target pilot pressure $P_{sbdn}$ is calculated from a resulting gain $K_{sbd}$ by referring to a metering table 201, and the calculated pilot pressure is converted, by referring to a voltage table 202, into an output voltage for the proportional solenoid pressure reducing valve 17 for dumping the second boom, followed by being output to the valve 17 through a multiplier (see FIG. 4) shown at the block B16.

Figure 10A:
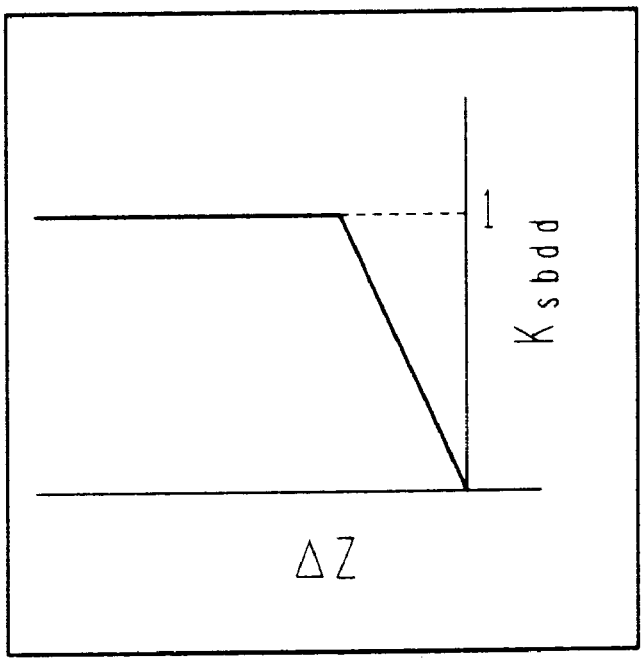
FIGS. 10*a* and 10*b* show a set of graphs showing, in enlarged scale, the relationship between the deviation ΔZ and a restoration gain set in the control gain block and the relationship between a second boom cylinder target speed and a feedback gain set in a feedback gain block.
Figure 10B:
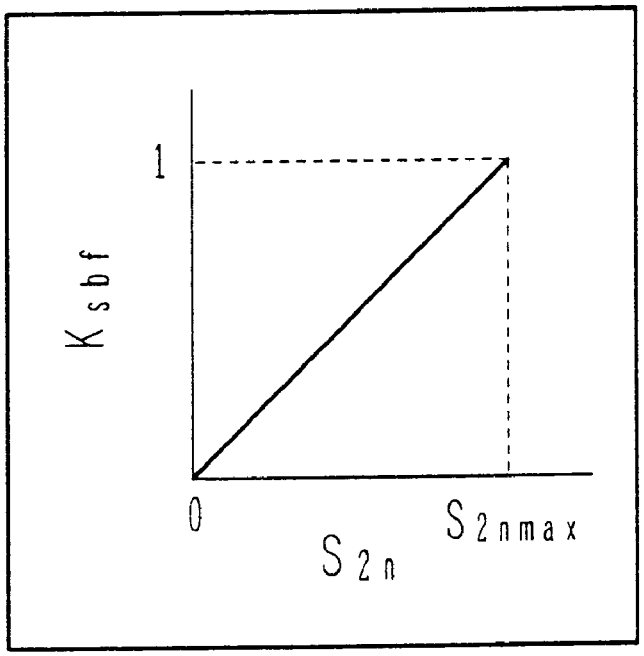

One example of the relationship between the deviation ΔZ and the restoration gain $K_{sbdd}$ set in the control gain block 200 is shown in FIG. 10(*a*) in enlarged scale. The relationship between the deviation ΔZ and the restoration gain $K_{sbdd}$ is set as follows. When the deviation ΔZ is a positive value, the restoration gain $K_{sbdd}$ is 0. When the deviation ΔZ becomes a negative value (i.e., when the arm end enters the restoration area), the restoration gain $K_{sbdd}$ is gradually increased as the deviation ΔZ reduces. When the deviation ΔZ is not larger than a certain negative value, the restoration gain $K_{sbdd}$ is kept at 1.

In the block 205, the arm end speed is calculated from the following formula:

$$P=\dot{P}_1+\dot{P}_2+\dot{P}_3=\begin{pmatrix}\dot{X}\\ \dot{Y}\\ \dot{Z}\end{pmatrix} \quad (3)$$

-continued $$\dot{P}_1=\dot{\theta}_1\begin{pmatrix}-L_1\sin\theta_1\\ L_1\cos\theta_1\\ 0\end{pmatrix}$$

$$\dot{P}_2=\begin{pmatrix}-(\dot{\theta}_1+\dot{\theta}_2)L_2\sin(\theta_1+\theta_2)\\ (\dot{\theta}_1+\dot{\theta}_2)L_2\cos(\theta_1+\theta_2)\\ 0\end{pmatrix}$$

$$\dot{P}_3=\begin{pmatrix}-L_3(\dot{\theta}_1+\dot{\theta}_2+\dot{\theta}_3)\sin(\theta_1+\theta_2+\theta_3)\\ L_3(\dot{\theta}_1+\dot{\theta}_2+\dot{\theta}_3)\cos(\theta_1+\theta_2+\theta_3)\\ 0\end{pmatrix}$$

("'") represents differentiation similarly to "'" in the description).

Figure 11:
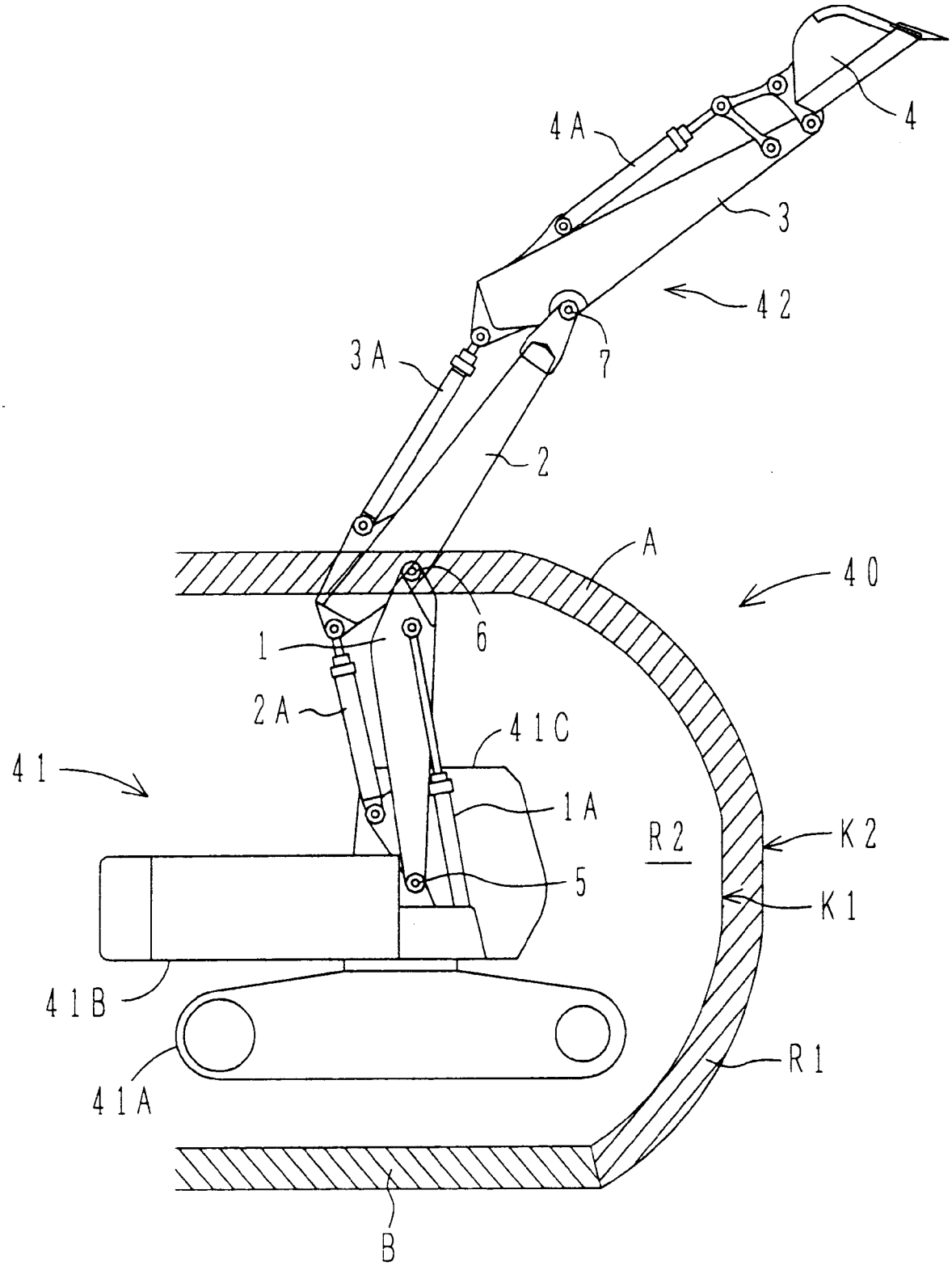
FIG. 11 is a view for explaining how to determine an arm end target speed.

In the block 206, the arm end target speed ($X'_n$, $Y'_n$) is determined by the following formulae:

$$X'_n=-X'$$
$$Y'_n=Y' \quad (4)$$

when the arm end enters R2 from the slowdown area R1 indicated by hatching A in FIG. 11, and $$X'_n=X'$$
$$Y'_n=-Y' \quad (5)$$

when the arm end enters R2 from the slowdown area R1 indicated by hatching B in FIG. 11.

In the block 207, the second-boom target angular speed $\theta'_{2n}$ is determined by the following formulae:

$$\dot{\theta}_{2n}=\frac{\dot{X}_n+\dot{\theta}_1(L_1\sin\theta_1+L_2\sin(\theta_1+\theta_2)+L_3\sin(\theta_1+\theta_2+\theta_3))+\dot{\theta}_3L_3\sin(\theta_1+\theta_2+\theta_3)}{-L_2\sin(\theta_1+\theta_2)-L_3\sin(\theta_1+\theta_2+\theta_3)} \quad (6)$$

when the arm end target speed determined in the block 206 is given by the formula (4), and $$\dot{\theta}_{2n}=\frac{\dot{X}_n+\dot{\theta}_1(L_1\cos\theta_1+L_2\cos(\theta_1+\theta_2)+L_3\cos(\theta_1+\theta_2+\theta_3))-\dot{\theta}_3L_3\sin(\theta_1+\theta_2+\theta_3)}{L_2\cos(\theta_1+\theta_2)+L_3\cos(\theta_1+\theta_2+\theta_3)} \quad (7)$$

when the arm end target speed determined in the block 206 is given by the formula (5).

One example of the relationship between the second-boom cylinder target speed $S_{2n}$ and the feedback gain $K_{sbf}$ set in the feedback gain block 209 is shown in FIG. 10(*b*) in enlarged scale. The relationship between the second-boom cylinder target speed $S_{2n}$ and the feedback gain $K_{sbf}$ is set such that the gain $K_{sbf}$ is 1, for example, when the second-boom cylinder target speed $S_{2n}$ is at maximum, and is reduced as the second-boom cylinder target speed $S_{2n}$ lowers.

A characteristic of the metering table 201 is a reversal of the characteristic relationship between the second-boom dumping pilot pressure $P_{sbd}$ and a cylinder target speed $M_{sbd}$ that is determined depending on an opening area characteristic of the flow control valve 11 in the direction to dump the second boom. Note that, for the horizontal axis of the metering table 201, the cylinder target speed $M_{sbd}$ is converted into a gain.

With the above functional arrangement, when the arm end enters the restoration area R2, the control gain block 200 calculates the restoration gain $K_{sbdd}$ corresponding to an intrusion amount by which the arm end enters the restoration area R2, while the feedback gain block 209 calculates the feedback gain corresponding to an arm end speed at that time. The second boom 2 is dumped at a speed depending on the intrusion amount of the arm end into the restoration area R2 and the arm end speed so that the arm end is moved for return to the slowdown area R1.

The operation of this embodiment thus constructed will now be described. The following description will be made on, as work examples, (a) the case of not raising the first boom, (b) the case of raising the first boom, but not crowding the arm, and (c) the case of raising the first boom and crowding the arm.

(a) Case of not Raising First Boom

In the case that the pilot valve 19 associated with the first-boom flow control valve 10 for raising the first boom is not operated, but any of the other pilot valves, e.g., the pilot valve 21 associated with the second-boom flow control valve 11 for crowding the second boom or the pilot valve 23 associated with the arm flow control valve 12 for crowding the arm, is operated, when the arm end position exceeds the boundary line K2 and enters the slowdown area R1, the proportional solenoid pressure reducing valve 16 or 18 is operated to reduce the pilot pressure for slowing down and stopping the cylinder 2A or 3A of the second boom 2 or the arm 3 so that the arm end is stopped at the boundary line K1, on the basis of the functions shown at 108, 109, 119, 110 and 111 or 112, 113, 123, 114 and 115 in FIG. 6.

At this time, the slowdown gain in the block 105 or 113 is modified to increase as the pilot pressure becomes higher, as described above in connection with FIG. 8(*b*). Therefore, when the arm end position exceeds the boundary line K2, the slowdown control is started regardless of the level of the pilot pressure and smooth slowdown control is always ensured.

The above description is also equally applied to when the pilot valve 20 associated with the first-boom flow control valve 10 for lowering the first boom is operated.

On the other hand, at that time, the first-boom raising pilot pressure $P_{fbu}$ is not input to the block B14 shown in FIG. 4 and the block B14 outputs a 0-level signal. Accordingly, the restoration control of the block B12 is not effected even though the arm end enters the restoration area R2 to some extent due to inertia of the work front 42.

Additionally, in work carried out by operating the second boom and/or the arm in the crowding direction without raising the first boom, the operator intends to carry out the operation only requiring the work front to be moved toward the operator (cab) in many cases. In such work, if the work front is moved in a direction away from the excavator body by dumping the second boom, the movement of the work front would be unexpected one for the operator, and if there is an object such as a wall in the dumping direction, the work front may hit against the object. By slowing down and stopping the work front as described above, the movement unexpected for the operator is avoided and good operability is ensured.

(b) Case of Raising First Boom, but not Crowding Arm

In the case that the pilot valve 19 associated with the first-boom flow control valve 10 for raising the first boom is operated, but the pilot valve 23 associated with the arm flow control valve 12 for crowding the arm is not operated, when the arm end position exceeds the boundary line K2 and enters the slowdown area R1, the proportional solenoid pressure reducing valve 13 is operated to reduce the pilot pressure for slowing down the first boom cylinder 1A to effect the slowdown control so that the first-boom raising speed is reduced to a value determined by the slowdown gain in the block 101 and the arm end speed is lowered correspondingly, on the basis of the functions shown at 100, 101, 117, 102 and 103 in FIG. 6.

On the other hand, at this time, the first-boom raising pilot pressure $P_{fbu}$ is input to the block B14 shown in FIG. 4 and the block B14 outputs a 1-level signal. Accordingly, when the arm end position exceeds the boundary line K1 and enters the restoration area R2, the block 13 also outputs a 1-level signal, whereupon the restoration control of the block 12 is started for moving the arm end position back to the slowdown area R1 outside the boundary line K1.

More specifically, the restoration gain is calculated depending on the intrusion amount of the arm end into the restoration area R2 in the control gain block 200 of FIG. 9, and the feedback gain is calculated depending on the arm end speed at that time on the basis of the functions shown at 204, 205, 206, 208 and 209. In accordance with those calculated gains, the second boom 2 is automatically dumped depending on the intrusion amount of the arm end into the restoration area R2 and the arm end speed at that time, causing the arm end position to be moved for return to the slowdown area R1.

Thus, when the arm end position exceeds the boundary line K2 and enters the slowdown area R1, the first-boom raising operation is slowed down to a predetermined speed, and when the arm end position exceeds the boundary line K1 and enters the restoration area R2, the arm end is controlled to move while going around the excavator body, particularly the cab, with a combination of the slowed-down first-boom raising operation and the second-boom dumping operation based on the restoration control. As a result, the work front can be continuously smoothly moved without being stopped while avoiding interference with the excavator body, particularly the cab, and working efficiency can be improved.

(c) Case of Raising First Boom and Crowding Arm

In the case that the pilot valve 19 associated with the first-boom flow control valve 10 for raising the first boom is operated and the pilot valve 23 associated with the arm flow control valve 12 for crowding the arm is also operated, the slowdown control and the restoration control described in the above (b) are both effected. In addition, as described in connection with FIG. 8(*c*), the modified slowdown gain Kac* is set to increase as the first-boom raising pilot pressure $P_{fbu}$ becomes higher, thereby suppressing a slowdown amount so that the arm end enters the restoration area R2 while maintaining a certain arm crowding speed corresponding to the first-boom raising speed, on the basis of the functions shown at 116, 120, 121 and 122 in FIG. 6.

If the arm crowding operation is also subject to the slowdown control so that the arm is stopped at the boundary line K1, the slowdown control of the arm crowding operation would be resumed upon the arm end being returned to the slowdown area R1 with the dumping of the second boom after entering the restoration area R2; hence the arm crowding operation would repeat the stop and slowdown, resulting in jerky movement of the work front.

With this embodiment, since the arm end enters the restoration area R2 while maintaining a certain arm crowding speed corresponding to the first-boom raising speed, the arm crowding operation is continuously subject to the slowdown control and the interference avoidance control can be smoothly performed.

According to this embodiment, as described above, when the arm end position exceeds the boundary line K1 and enters the restoration area R2, the arm end is moved for return to the slowdown area R1 with the dumping of the second boom. Therefore, the work front is prevented from interfering with the cab without being stopped, and such work as requiring the work front to be moved toward the operator (cab) can be continuously smoothly performed.

Also, since the restoration control is performed with the dumping of the second boom, as described above, under the operation of raising the first boom, the arm end is controlled to move while going around the cab with a combination of the first-boom raising operation and the second-boom dumping operation based on the restoration control. As a result, the interference avoidance control can be smoothly achieved.

Further, in work carried out by not operating the first boom in the rising direction, but operating the second boom and/or the arm in the crowding direction, the work front is controlled to just slow down and stop when the predetermined position of the work front comes close to the excavator body. Hence the movement unexpected for the operator is avoided and good operability is ensured.

Moreover, since the slowdown control is first effected when the arm end position exceeds the boundary line K2 and the restoration control is then performed with the dumping of the second boom, the flow rate supplied to the first boom cylinder 1A is reduced and the second boom cylinder 2A can be supplied with the hydraulic fluid at a sufficient flow rate, enabling the second boom 2 to be quickly dumped, even when there is a limit in maximum capacity of the hydraulic pump 29. Also, since the front members are slowed down before starting to control the second boom to dump, the intrusion amount of the arm end into the restoration area R2 is suppressed. It is thus possible to surely prevent interference between the work front and the excavator body.

In addition, since the second boom 2 is dumped in accordance with the feedback gain which is calculated depending on the arm end speed, a dumping speed of the second boom in match with the arm end speed is obtained and smooth interference avoidance control is achieved. Also, since the restoration gain is calculated depending on the intrusion amount of the arm end into the restoration area R2, the second boom dumping speed is increased as the arm end comes closer to the cab, and interference between the work front and the excavator body can be surely prevented.

Under the combined operation of raising the first boom and crowding the arm, when the arm end enters the restoration area R2, it is controlled to maintain a certain arm crowding speed at the time of entering the restoration area R2. Accordingly, the arm crowding operation is avoided from repeating the stop and slowdown in the restoration control with the dumping of the second boom and smooth interference avoidance control can be achieved.

Since the slowdown gain is modified by being multiplied by the cylinder target speed obtained in the metering characteristic block, when the deviation ΔZ becomes not larger than the slowdown start distance r0, the slowdown control is started in accordance with the predetermined characteristic regardless of the level of the operation pilot pressure, and smooth slowdown control can be always ensured.

Additionally, in this embodiment, when the arm end position enters the restoration area R2, the arm end is moved for return to the slowdown area R1 with the dumping of the second boom, as described above, whereby the work front is prevented from interfering with the cab without being stopped. In this respect, the movement of the arm end for return to the slowdown area R1 (i.e., the movement of the arm end away from the cab) can also be obtained by moving the arm in the dumping direction, as described later. However, the arm is a front member which is employed to carry out work itself during ordinary work (e.g., excavating). If the arm is dumped in the crowding direction under action of the above-described control during work that is carried out by the operator manipulating the control lever to move the arm in the crowding direction, this means that the arm is moved contrary to the intent of the operator, thus making the operator feel awkward. On the other hand, the second boom of the 2-piece boom type hydraulic excavator is employed in many cases as the so-called positioning boom to select a region of work in the longitudinal direction before starting the work, and is less frequently employed in actual work. This means that even when the second boom is moved in the dumping direction under the above-described control, a degree of awkward feeling perceived by the operator is small. As a result, in this embodiment, the interference avoidance control can be smoothly performed without impairing an operation feeling of the operator.

Thus, with this embodiment, such work as requiring the work front to be moved toward the operator can be continuously smoothly performed and working efficiency can be greatly improved.

A second embodiment of the present invention will be described with reference to FIGS. 12 and 13. While only the second boom is dumped under the restoration control in the first embodiment, the second boom and the arm are both dumped in this second embodiment. In those drawings, equivalent members or functions to those shown in FIGS. 1 and 9 are denoted by the same reference numerals.

Figure 12:
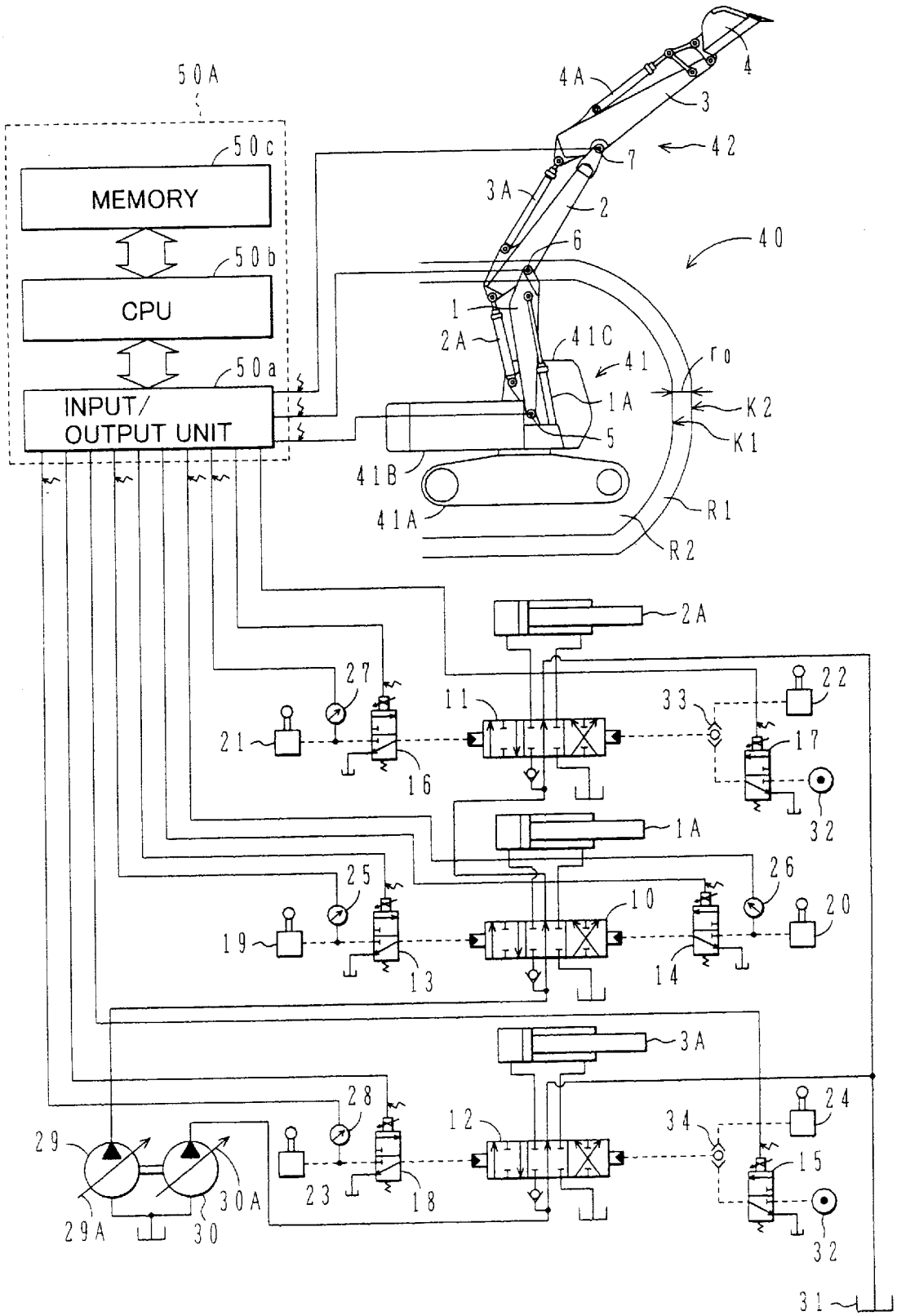
FIG. 12 is a schematic view showing an interference prevention system for a 2-piece boom type hydraulic excavator according to a second embodiment of the present invention.

In FIG. 12, an interference prevention system according to this embodiment comprises, in addition to the components of the first embodiment shown in FIG. 1, a proportional solenoid pressure reducing valve 15 for reducing the pilot pressure supplied from the pilot hydraulic source 32, and a shuttle valve 34 for selecting higher one of the pilot pressure output from the pilot valve 24 and the pilot pressure output from the proportional solenoid pressure reducing valve 15 and applying the selected pilot pressure to the flow control valve 12.

An overall control algorithm of a controller 50A is the same as in the first embodiment shown in FIG. 4. Also, details of the control algorithm is the same as in the first embodiment except the restoration control in the block B12.

Figure 13:
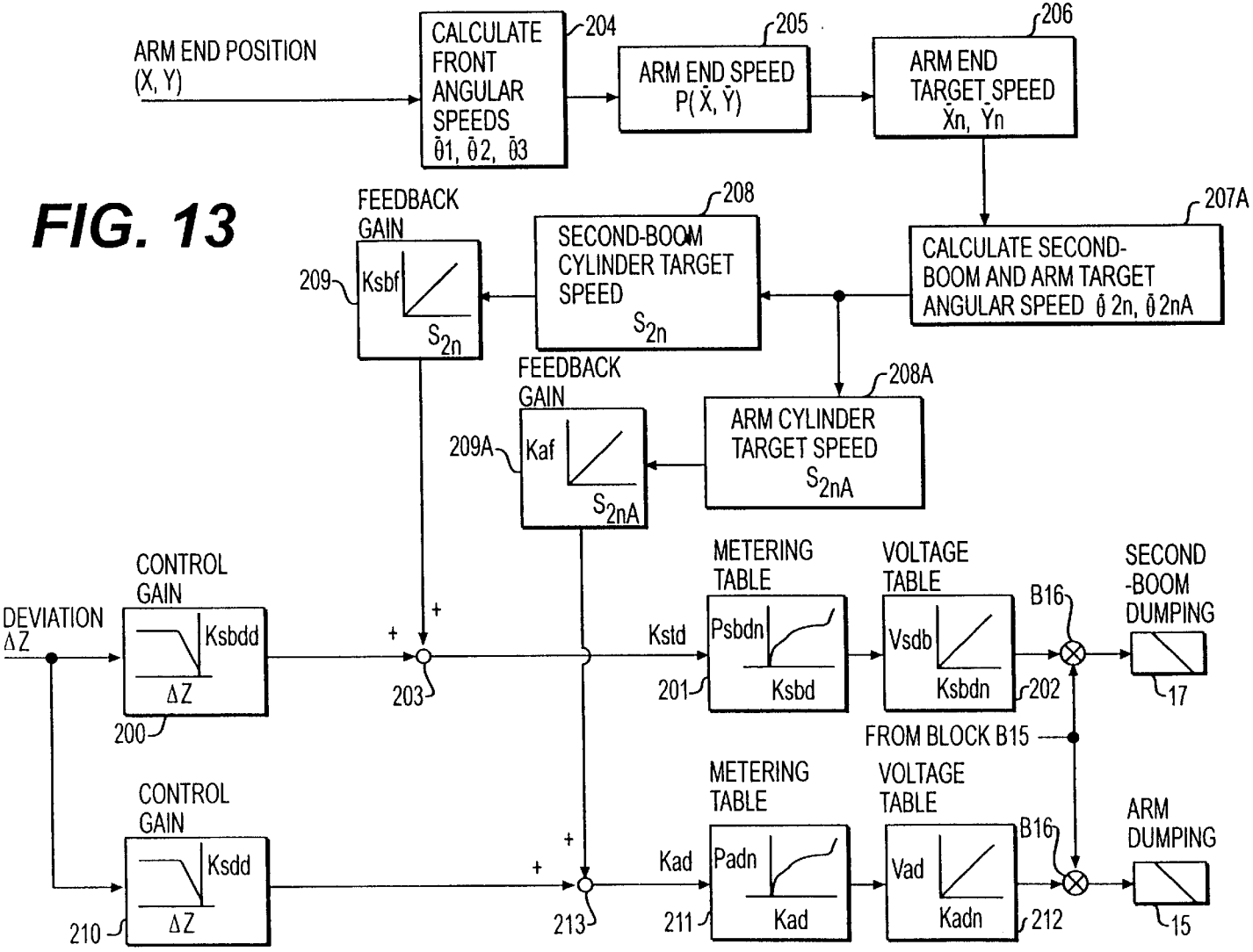
FIG. 13 is a functional block diagram showing details of restoration control.

Details of the restoration control in the block B12 is shown in a functional block diagram of FIG. 13.

Referring to FIG. 13, the control algorithm in this embodiment comprises, in addition to the blocks 208, 209, 200, 203, 201 and 202 associated with the operation of dumping the second boom, blocks 208, 209, 200, 203, 201 and 202 associated with the operation of dumping the arm.

Also, a block 207A calculates, in addition to the second-boom target angular speed $\theta'_{2n}$, an arm target angular speed $\theta'_{2nA}$ from the arm end target speed $(X'_n, Y'_n)$, and a block 208A determines an arm cylinder target speed $S_{2nA}$ from the arm target angular speed $\theta'_{2nA}$. Further, a feedback gain block 209A determines a feedback gain $K_{af}$ from the arm cylinder target speed $S_{2nA}$.

A control gain block 210 calculates a restoration gain $K_{acd}$ for the arm dumping operation from the deviation ΔZ. As with the restoration gain $K_{sbdd}$ for the second-boom dumping operation described in connection with the first embodiment, the feedback gain $K_{af}$ obtained on the basis of the functions shown at 204, 205, 206, 207A, 208A and 209A is added, in an adder 213, to the restoration gain $K_{acd}$ calculated in the control gain block 210. A target pilot pressure $P_{acn}$ is calculated from a resulting gain $K_{ac}$ by referring to a metering table 211, and the calculated pilot pressure is converted, by referring to a voltage table 212, into an output voltage for the proportional solenoid pressure reducing valve 15 for dumping the arm, followed by being output to the valve 15 through the multiplier (see FIG. 4) shown at the block B16.

The relationship between the deviation ΔZ and the restoration gain $K_{add}$ set in the control gain block 210 and the relationship between the arm cylinder target speed $S_{2nA}$ and the feedback gain $K_{af}$ set in the feedback gain block 209A are essentially the same as those ones shown in FIGS. 10(*a*) and 10(*b*), respectively.

A characteristic of the metering table 211 is a reversal of the characteristic relationship between an arm dumping pilot pressure $P_{ad}$ and a cylinder target speed $M_{ad}$ that is determined depending on an opening area characteristic of the flow control valve 12 in the direction to dump the arm. Note that, for the horizontal axis of the metering table 211, the cylinder target speed is also converted into a gain.

With the above functional arrangement, when the arm end enters the restoration area R2, the control gain blocks 200, 210 respectively calculate the restoration gains $K_{sbdd}$, $K_{add}$ corresponding to an intrusion amount by which the arm end enters the restoration area R2, while the feedback gain blocks 209, 209A calculates the feedback gains corresponding to an arm end speed at that time. The second boom 2 and the arm 3 are dumped at respective speeds depending on the intrusion amount of the arm end into the restoration area R2 and the arm end speed so that the arm end is moved for return to the slowdown area R1.

In this embodiment, therefore, since the arm end is moved for return to the slowdown area R1 with the dumping of both the second boom 2 and the arm 3, the arm end is controlled to quickly move while going around the excavator body more smoothly, and working efficiency is further improved.

A third embodiment of the present invention will be described with reference to FIGS. 14 and 15. While the pilot valves are used as operating means in the above embodiments, this third embodiment uses electric levers as operating means.

Figure 14:
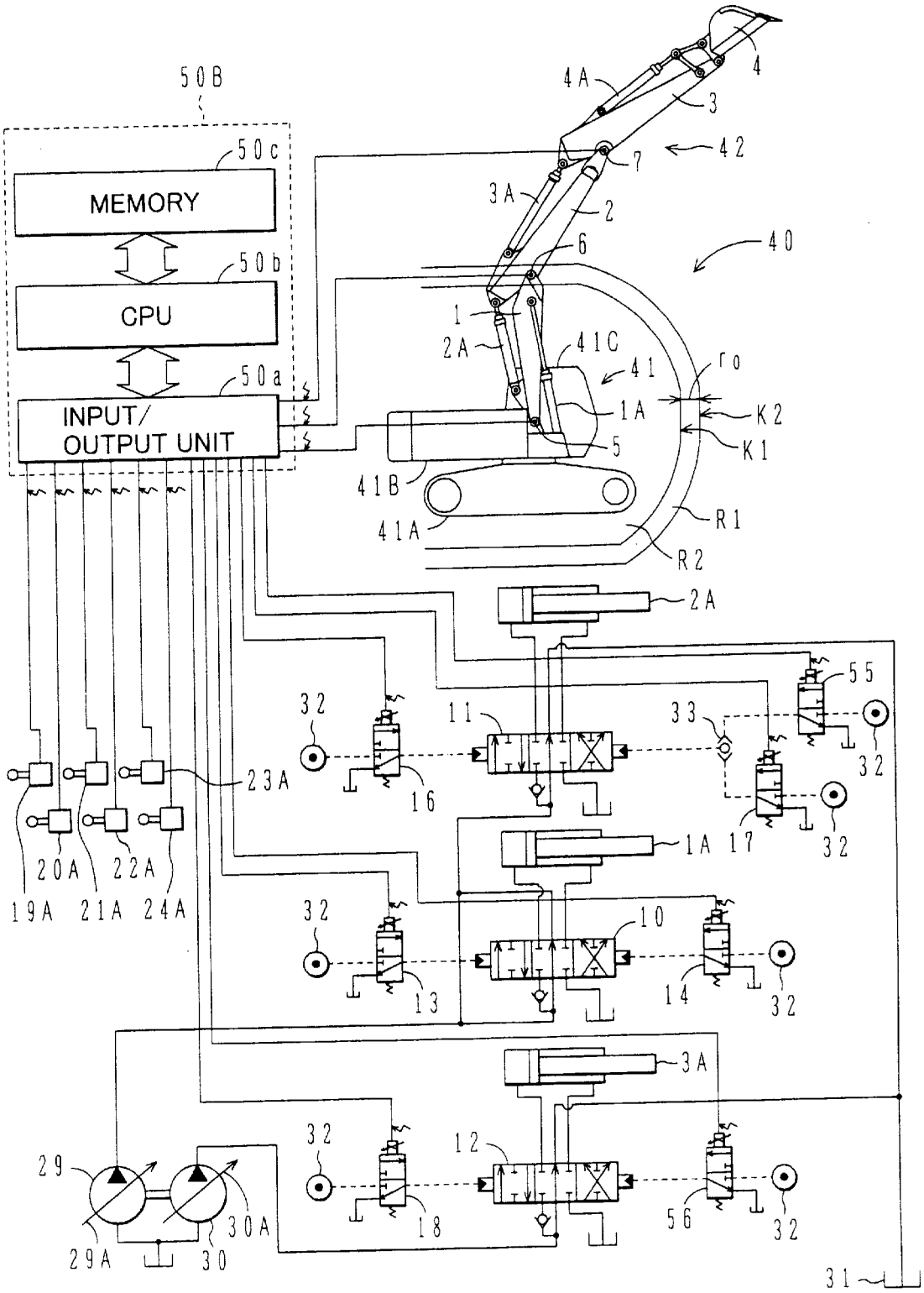
FIG. 14 is a schematic view showing an interference prevention system for a 2-piece boom type hydraulic excavator according to a third embodiment of the present invention.

In FIG. 14, an interference prevention system according to this embodiment has electric lever units 19A–24A instead of the pilot valves 19–24 as operating means in the first embodiment shown in FIG. 1. In respective pilot operating systems of the flow control valves 10, 11 and 12, there are provided proportional solenoid pressure reducing valves 13, 14, 16, 55, 18 and 56 for generating pilot pressures depending on stroke amounts by which the electric lever units 19A–24A are operated, based on the pilot pressure from the pilot hydraulic source 32. There is also provided a proportional solenoid pressure reducing valve 17 for reducing the pilot pressure from the pilot hydraulic source 32. Higher one of the pilot pressure output from the pilot valve 55 and the pilot pressure output from the proportional solenoid pressure reducing valve 17 is selected by a shuttle valve 33 and then applied to the flow control valve 11.

A controller 50B receives signals from the electric lever units 19A–24A and the angle sensors 5, 6, 7 and the pressure sensors 25, 26, 27, 28, and outputs control signals for controlling the work front 42 to the proportional solenoid pressure reducing valves 13, 14, 16, 55, 17, 18 and 56 based on the received operation signals and angle signals.

Figure 15:
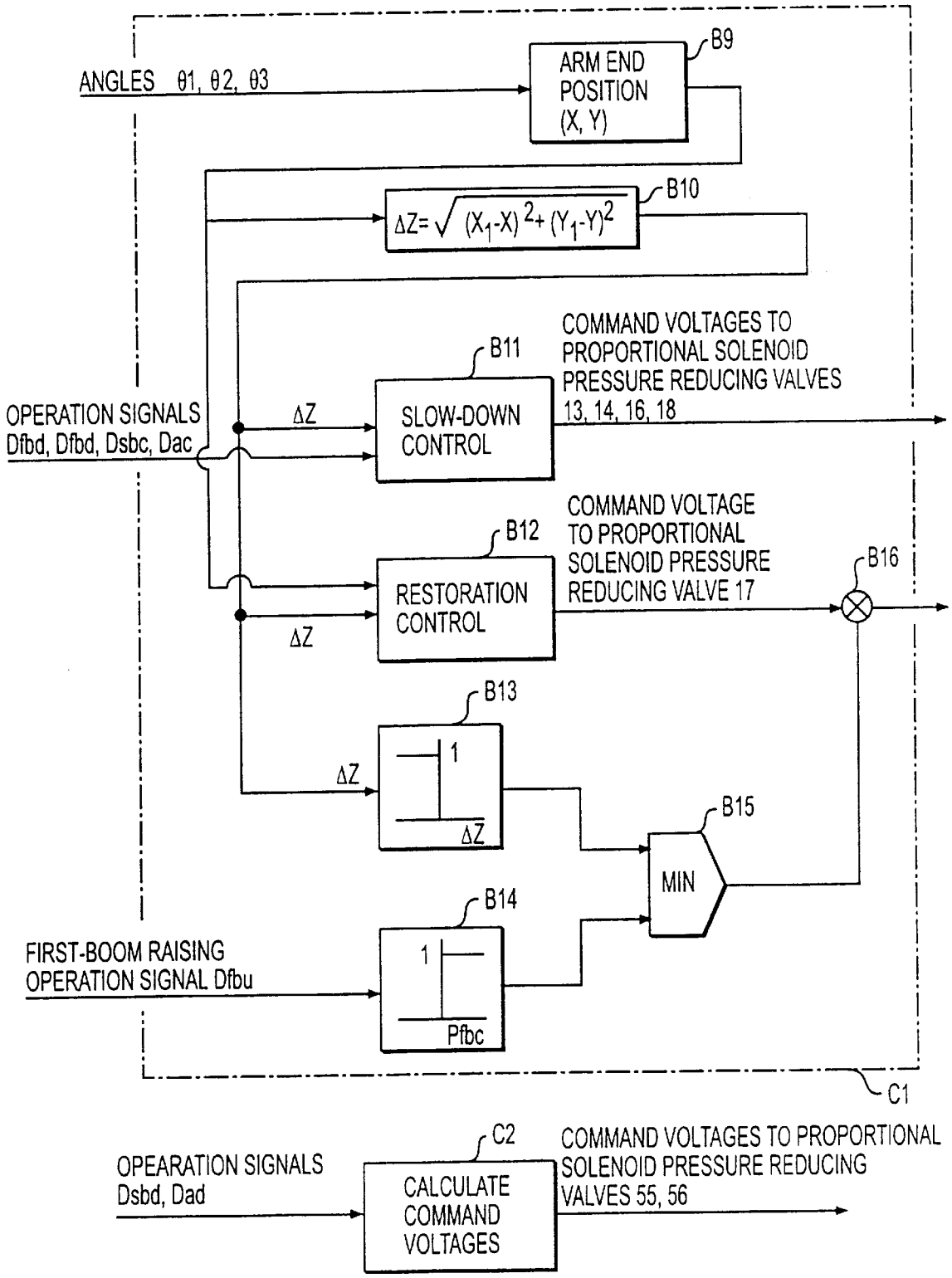
FIG. 15 is a functional block diagram showing a control algorithm of a controller.

An overall control algorithm of the controller 50B is shown in FIG. 15. The controller 50B has a section C2 for calculating and outputting command voltage for the proportional solenoid pressure reducing valves 55, 56 in addition to a similar section C1 for calculating and outputting command voltages for the proportional solenoid pressure reducing valves 13, 14, 16, 17 and 18 as shown in FIG. 4. Note that operation signals input to the section C1 are given as operation signals (electric signals) $D_{fbu}$, $D_{gbd}$, $D_{sbc}$ and $D_{ac}$ from the respective electric lever units substituted for the operation pilot pressures. Details of a slowdown control block B11 and a restoration control block B12 is the same as shown in FIGS. 6 and 9 except that metering characteristics are set to be adaptable for the electric signals from the electric lever units.

In the section C2, operation signals $D_{sbd}$ and $D_{ad}$ from the electric lever units 22A, 24A are converted into the command voltages based on a metering characteristic block (e.g., 100 in FIG. 6), a metering table (e.g., 102 in FIG. 6) and a voltage table (e.g., 103 in FIG. 6), followed by being output to the proportional solenoid pressure reducing valves 55, 56.

This embodiment thus constructed operates in a similar manner to the first embodiment, and hence can provide similar advantages in a system using the electric lever units as operating means to those obtainable with the first embodiment.

A fourth embodiment of the present invention will be described with reference to FIGS. 16–18. In this embodiment, the arm is dumped instead of the second boom. In those drawings, equivalent members or functions to those shown in FIGS. 1, 6, 9, 12 and 13 are denoted by the same reference numerals.

Figure 16:
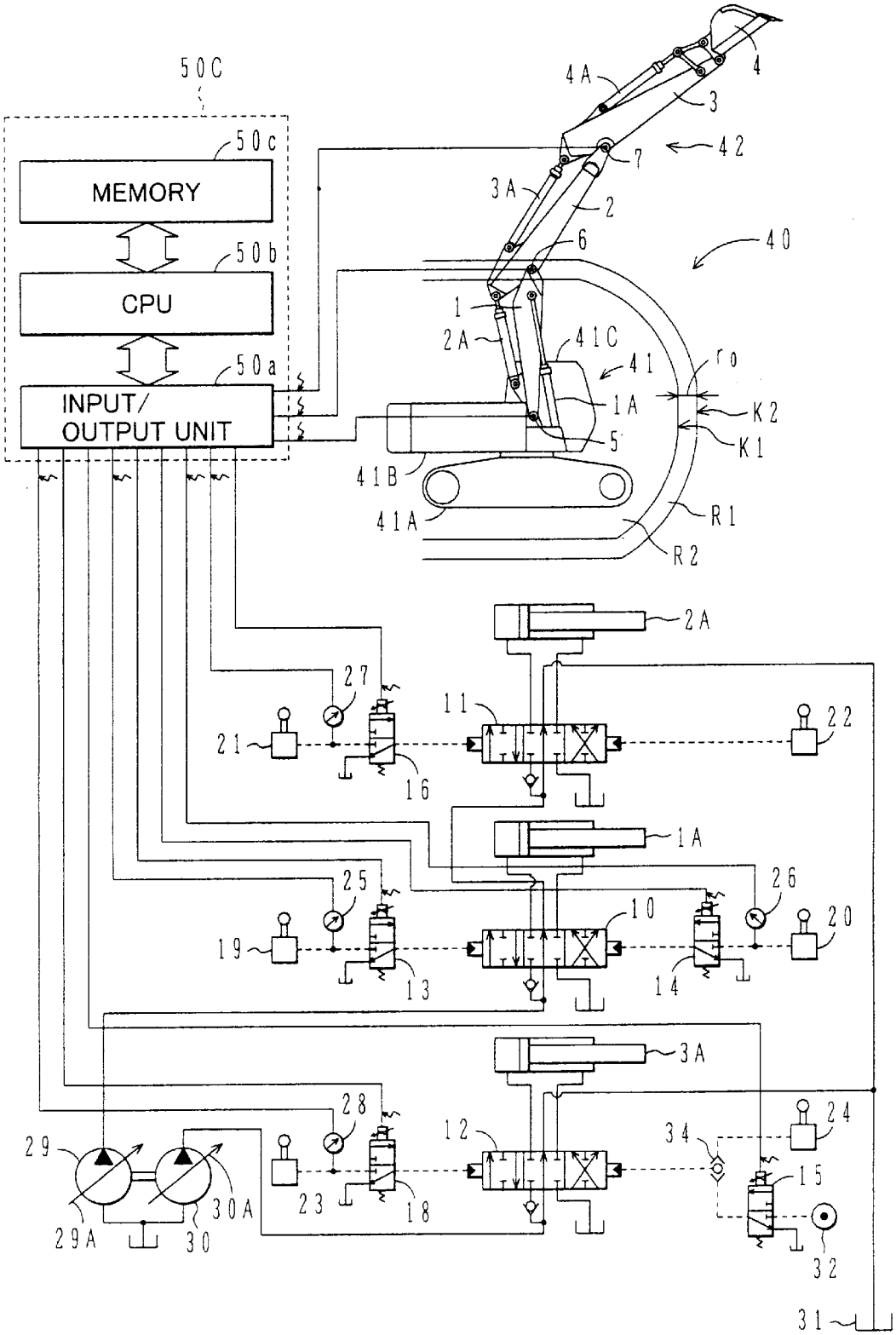
FIG. 16 is a schematic view showing an interference prevention system for a 2-piece boom type hydraulic excavator according to a fourth embodiment of the present invention.

In FIG. 16, an interference prevention system according to this embodiment includes a proportional solenoid pressure reducing valve 15 and a shuttle valve 34 which are associated with the arm flow control valve 12 only in the direction to dump the arm and are similar to those used in the second embodiment shown in FIG. 12, instead of the proportional solenoid pressure reducing valve 17 and the shuttle valve 22 which are associated with the second-boom flow control valve 11 in the direction to dump the second boom in the first embodiment shown in FIG. 1.

An overall control algorithm of a controller 50C is the same as in the first embodiment shown in FIG. 4.

Figure 17:
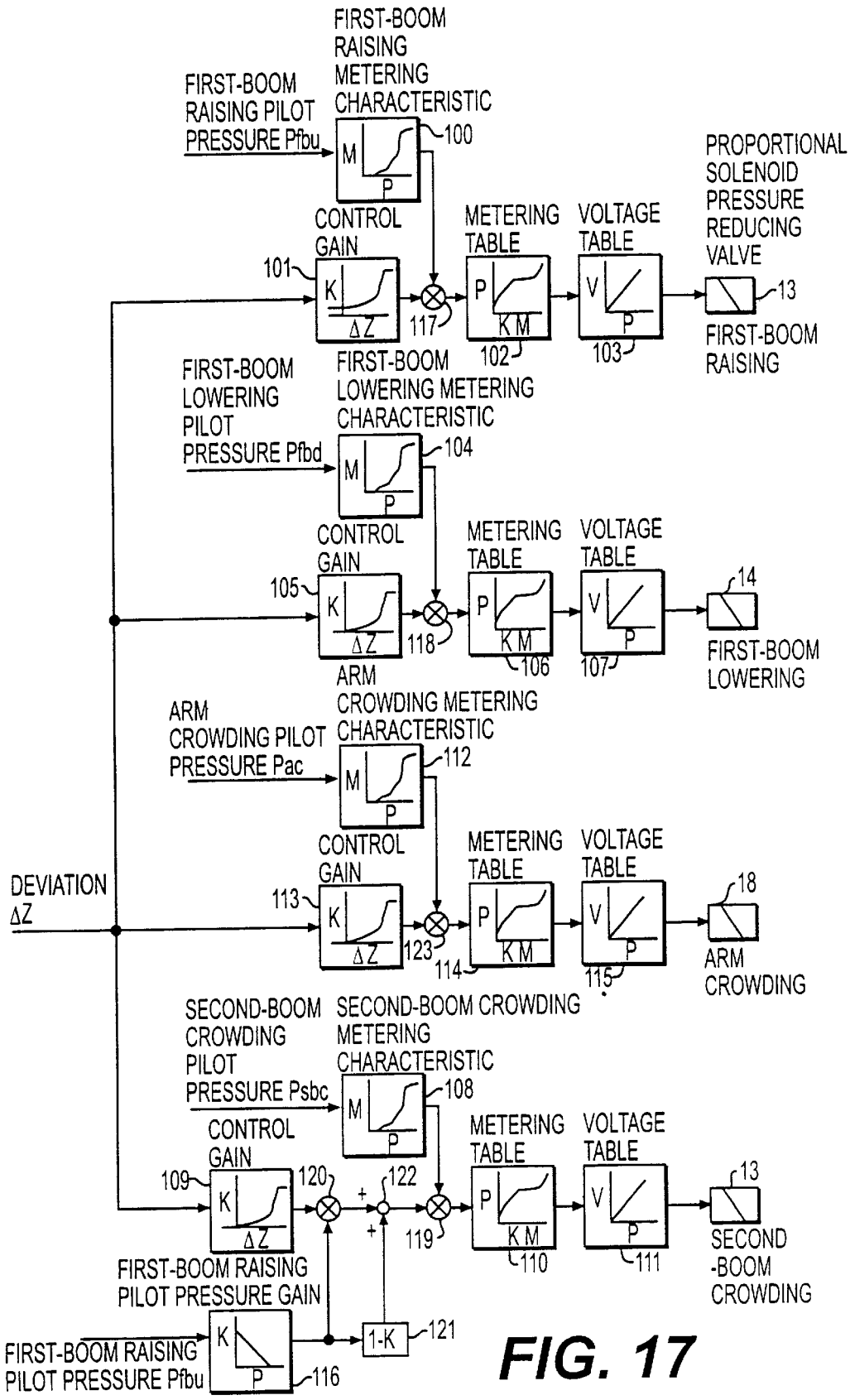
FIG. 17 is a functional block diagram showing details of slowdown control.

Details of restoration control in a block B11 (see FIG. 4) of the controller 50C is shown in a functional block diagram of FIG. 17.

In this embodiment, since the arm is dumped instead of the second boom, a control process of the proportional solenoid pressure reducing valve 13 for crowding the second boom and a control process of the proportional solenoid pressure reducing valve 18 for crowding the arm in the functional block diagram for the slowdown control are replaced with each other as compared with those control processes shown in FIG. 6.

More specifically, the proportional solenoid pressure reducing valve 18 for crowding the arm is controlled with a control gain block 113, an arm crowding metering characteristic block 112, a multiplying block 123, a metering table 114, and a voltage table 115. On the other hand, the proportional solenoid pressure reducing valve 13 for crowding the second boom is controlled with a control gain block 109, a second-boom crowding metering characteristic block 108, a multiplying block 119, a metering table 110, and a voltage table 111, as well as a first-boom raising pilot pressure gain block 116 and blocks 120–123 in which gains obtained in the blocks 109, 116 are combined with each other. At the time when the arm end exceeds the boundary line K1 (see FIG. 11), it is controlled to enter the restoration area R2 while maintaining a certain second-boom crowding speed corresponding to the first-boom raising speed, so that the second boom crowding control is prevented from interfering with the arm dumping control.

Figure 18:
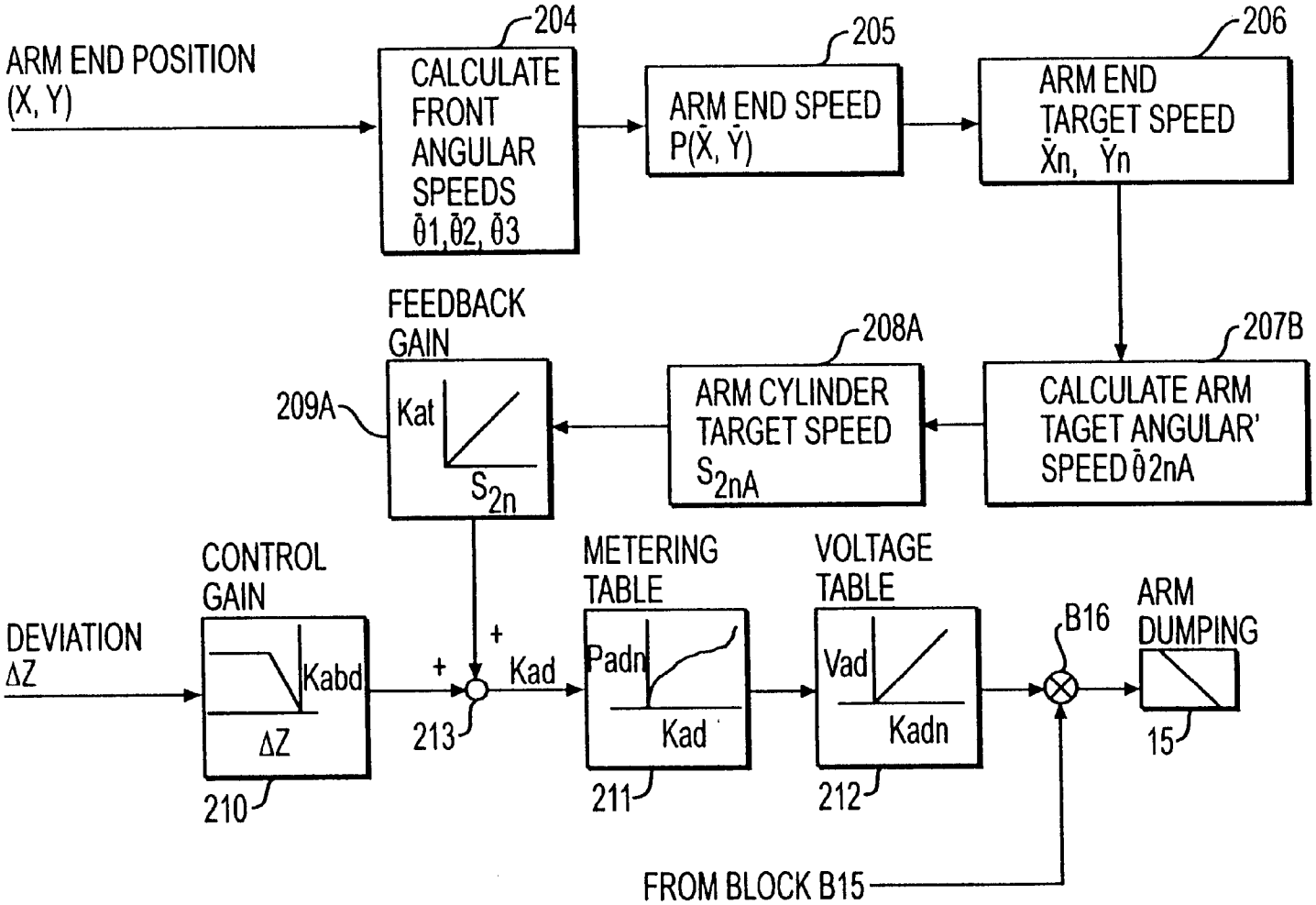
FIG. 18 is a functional block diagram showing details of restoration control.

Details of restoration control in a block B12 (see FIG. 4) of the controller 50C is shown in a functional block diagram of FIG. 18. The control algorithm in this embodiment includes blocks 207B, 208A, 209A, 210, 213, 211 and 212 associated with the operation of dumping the arm, instead of the blocks 207, 208, 209, 200, 203, 201 and 202 associated with the operation of dumping the second boom in the first embodiment shown in FIG. 9.

The block 207B calculates an arm target angular speed $\theta'_{2nA}$ from the arm end target speed $(X'_n, Y'_n)$. Functions of the other blocks 208A, 209A, 213, 211 and 212 are similar to those in the second embodiment shown in FIG. 13.

With such a functional arrangement, when the arm end enters the restoration area R2 (see FIG. 11), the control gain block 210 calculates the restoration gain $K_{add}$ corresponding to an intrusion amount by which the arm end enters the restoration area R2, while the feedback gain block 209 calculates the feedback gain corresponding to an arm end speed at that time. The arm 3 is dumped at a speed depending on the intrusion amount of the arm end into the restoration area R2 and the arm end speed so that the arm end is moved for return to the slowdown area R1.

In this embodiment, therefore, since the arm end is moved for return to the slowdown area R1 with the dumping of the arm 3, the arm end is controlled to move while going around the excavator body, and such work as requiring the work front to be moved toward the operator can be continuously smoothly performed.

Industrial Applicability

According to the present invention, when the predetermined position of the work front comes close to the excavator body, the second boom is controlled so as to dump. It is therefore possible to continuously smoothly carry out such work as requiring the work front to be moved toward the operator (cab) while avoiding interference between the work front and the cab, and to greatly improve working efficiency.

What is claimed is:

1. An interference prevention system for a 2-piece boom type hydraulic excavator, said interference prevention system being installed in a 2-piece boom type hydraulic excavator comprising an excavator body, a work front mounted on said excavator body and having a plurality of front members including first and second booms and an arm which are vertically rotatable, a first boom cylinder for driving said boom, a second boom cylinder for driving said second boom, an arm cylinder for driving said arm, a first-boom flow control valve for controlling a flow rate of a hydraulic fluid supplied to said first boom cylinder in accordance with an operation signal from first-boom operating means, a second-boom flow control valve for controlling a flow rate of a hydraulic fluid supplied to said second boom cylinder in accordance with an operation signal from second-boom operating means, and an arm flow control valve for controlling a flow rate of a hydraulic fluid supplied to said arm cylinder in accordance with an operation signal from arm operating means, said interference prevention system serving to restrict movement of said work front when a predetermined position of said work front comes close to said excavator body, wherein said interference prevention system comprises:

attitude detecting means for detecting an attitude of said work front, and control means for receiving detection signals from said attitude detecting means and, when the predetermined position of said work front comes close to said excavator body, outputting a command signal to said second-boom flow control valve so that said second boom is moved in a dumping direction.

2. An interference prevention system for a 2-piece boom type hydraulic excavator according to claim 1, wherein when said first boom is operated in a rising direction by said operating means for said first boom, said control means makes control to move said second boom in the dumping direction while continuing to raise said first boom.

3. An interference prevention system for a 2-piece boom type hydraulic excavator according to claim 2, wherein said control means receives an operation signal in the first-boom raising direction output from said operating means for said first boom, and modifies the operation signal in the first-boom raising direction such that first-boom raising operation is slowed down as the predetermined position of said work front comes closer to said excavator body, and thereafter the first-boom raising operation is continued at a slowed-down speed.

4. An interference prevention system for a 2-piece boom type hydraulic excavator according to claim 2, wherein said control means receives an operation signal in a second-boom crowding direction output from said operating means for said second boom and an operation signal in an arm crowding direction output from said operating means for said arm, and modifies the operation signal in the second-boom crowding direction and the operation signal in the arm crowding direction such that when said first boom is not moved in the rising direction, said work front is slowed down as the predetermined position of said work front comes closer to said excavator body and thereafter the work front is stopped.

5. An interference prevention system for a 2-piece boom type hydraulic excavator according to claim 2, wherein said control means receives an operation signal in an arm crowding direction output from said operating means for said arm, and modifies the operation signal in the arm crowding direction such that when said first boom is moved in the rising direction, an arm crowding operation is slowed down as the predetermined position of said work front comes closer to said excavator body, and thereafter the arm crowding operation is continued at a slowed-down speed.

6. An interference prevention system for a 2-piece boom type hydraulic excavator according to claim 1, wherein said control means calculates a target speed of said second boom in the dumping direction corresponding to a moving speed of the predetermined position of said work front, and makes said control so that said second boom is moved at the calculated target speed.

7. An interference prevention system for a 2-piece boom type hydraulic excavator according to claim 6, wherein said control means calculates the target speed of said second boom in the dumping direction to provide a higher target speed value as a moving speed of the predetermined position of said work front increases.

8. An interference prevention system for a 2-piece boom type hydraulic excavator according to claim 1, wherein said control means calculates a target speed of said second boom in the dumping direction that increases as the predetermined position of said work front comes closer to said excavator body, and makes said control so that said second boom is moved at the calculated target speed.

9. An interference prevention system for a 2-piece boom type hydraulic excavator according to claim 1, wherein:

said attitude detecting means includes means for calculating a distance ($\Delta Z$) from the predetermined position of said work front to an area previously set around said excavator body, and said control means modifies the operation signals from said operating means such that when said calculated distance is not larger than a preset first control start distance, said work front is gradually slowed down as said calculated distance becomes smaller, modifies the operation signals from said operating means such that when said calculated distance reaches a preset second control start distance smaller than said first control start distance, said front members are stopped except at least operation of raising said first boom, and makes control such that when said calculated distance is not larger than said second control start distance, said second boom is moved in the dumping direction.

10. An interference prevention system for a 2-piece boom type hydraulic excavator according to claim 9, wherein said control means modifies the operation signals from said operating means such that when said calculated distance ($\Delta Z$) reaches said preset second control start distance smaller than said first control start distance, said front members are stopped except operations of raising said first boom and crowding said arm.

11. An interference prevention system for a 2-piece boom type hydraulic excavator according to claim 9, wherein said control means receives the operation signals from said operating means and modifies the operation signals from said operating means such that a degree of slowdown is reduced with an increase in stroke amounts by which said operating means are operated.

12. An interference prevention system for a 2-piece boom type hydraulic excavator according to claim 1, wherein when the predetermined position of said work front comes close to said excavator body, said control means outputs command signals to said second-boom flow control valve and said arm flow control valve so that said second boom and said arm are both moved in the dumping direction.

13. An interference prevention system for a 2-piece boom type hydraulic excavator according to claim 1, wherein when the predetermined position of said work front comes close to said excavator body, said control means outputs a command signal to said arm flow control valve so that said arm is moved in the dumping direction instead of said second boom.

* * * * *